US010388190B2

(12) United States Patent
Virmalo

(10) Patent No.: US 10,388,190 B2
(45) Date of Patent: Aug. 20, 2019

(54) ENCAPSULATED SIGNAGE AND METHOD OF PRODUCTION

(71) Applicant: Udo Virmalo, Mystic, CT (US)

(72) Inventor: Udo Virmalo, Mystic, CT (US)

(73) Assignee: National Marker Company, North Smithfield, RI (US)

( * ) Notice: Subject to any disclaimer, the term of this patent is extended or adjusted under 35 U.S.C. 154(b) by 0 days.

(21) Appl. No.: 14/268,505

(22) Filed: May 2, 2014

(65) Prior Publication Data

US 2015/0317920 A1 Nov. 5, 2015

(51) Int. Cl.

| | |
|---|---|
| ***G09F 3/02*** | (2006.01) |
| ***G09F 7/00*** | (2006.01) |
| ***G09F 7/18*** | (2006.01) |

(52) U.S. Cl.

CPC ..... *G09F 3/02* (2013.01); *G09F 7/00* (2013.01); *G09F 7/18* (2013.01); *G09F 2003/0202* (2013.01); *G09F 2003/0255* (2013.01); *G09F 2003/0257* (2013.01)

(58) Field of Classification Search

None

See application file for complete search history.

(56) References Cited

U.S. PATENT DOCUMENTS

| | | | | |
|---|---|---|---|---|
| 4,250,646 | A * | 2/1981 | Trachtenberg | 40/582 |
| 5,442,870 | A * | 8/1995 | Kochanowski | 40/582 |
| 5,764,262 | A | 6/1998 | Wu | |
| 5,773,112 | A * | 6/1998 | Tachikawa et al. | 428/40.1 |
| 5,840,657 | A * | 11/1998 | Mehta et al. | 504/280 |
| 6,253,477 | B1 * | 7/2001 | Balint | 40/612 |
| 6,899,775 | B2 | 5/2005 | Hill | |
| 7,098,256 | B2 | 8/2006 | Ong | |
| 8,172,300 | B2 | 5/2012 | McCormick | |
| 8,182,875 | B2 | 5/2012 | Anderson | |
| 8,337,987 | B2 | 12/2012 | Nesbitt | |
| 2002/0150734 | A1 | 10/2002 | Snow | |
| 2003/0019424 | A1 | 1/2003 | Takekoshi | |
| 2004/0029030 | A1 | 2/2004 | Murray | |

(Continued)

*Primary Examiner* — Laura C Powers

(74) *Attorney, Agent, or Firm* — Varnum, Riddering, Schmidt & Howlett LLP

(57) ABSTRACT

An article of manufacture (160) in the form of a sign or label comprises a disclosed embodiment, produced in accordance with an example method. A substrate (170) is provided which forms a flat planar surface area having a desired shape, thickness and size. A design layer is formed through the use of inks and/or paints (172) applied to the substrate (170) in a predetermined pattern. When the inks and/or paints (172) are applied to the substrate (170), no ink or paint (172) is applied on one or more edges formed around the periphery of the sign (160) for an edge bare border (164). Also, a mounting hole (168) is provided, and an opening bare border (166) is formed around the mounting hole (168). A protective coating (176) is then applied over the inks and/or paints (172) so as to provide a protective cover. Also, the protective coating (176) is applied to the edge bare border (164) and the openings bare border (166) so that the protective coating (176) fully covers not only the inks and/or paints (172), but also all borders, thereby fully encapsulating edge bare borders (164) and an openings bare border (166) between the protective coating and the substrate.

1 Claim, 17 Drawing Sheets

(56) References Cited

U.S. PATENT DOCUMENTS

| | | | |
|---|---|---|---|
| 2004/0109957 | A1 | 6/2004 | Sen |
| 2004/0219311 | A1 | 11/2004 | Wickramanayake |
| 2008/0014513 | A1 | 1/2008 | Sisler |
| 2009/0098293 | A1 | 4/2009 | Hoffmann |
| 2010/0154669 | A1 | 6/2010 | Borremans |
| 2010/0209621 | A1 | 8/2010 | Wakalopulos |
| 2012/0115975 | A1 | 5/2012 | Kania |
| 2012/0273576 | A1 | 11/2012 | Womczyk |

* cited by examiner

ENCAPSULATED SIGNAGE AND METHOD OF PRODUCTION

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

Field of the Invention

The invention relates generally to signage and labels, et. al. manufactured by "printing" images, logos, pictograms, legends, messages, and other indicia onto various substrates formed from plastics, metals, paper, and other flat ink receptive materials. The printing process encompasses any of a number of commercially available methods to apply inks onto flat substrates in high or low volume quantities at commonly used production rates. More specifically, the invention relates to creating indicia designs and manufacturing articles which maximize the effectiveness of surface coatings by achieving substantially 100% encapsulation of the indicia between the protective surface coating and the substrate. Indicia on an article includes any letters, numerals, characters, graphics, images, stripes, borders, etc. and background color(s) formed by applying ink(s) onto a substrate.

Background Art

Signs, labels, posters, cards, marks, way finding, directional, emblems, decals, et al. are terms used to describe articles that convey a static message or information to a viewer(s). Such articles typically exhibit many of the following properties: (1) they are constructed from natural or man-made materials; (2) they are produced in a range of sizes, with few absolute dimensional limitations; (3) they are manufactured in lot sizes from one to thousands; (4) they are used by almost every industrial, professional, commercial, governmental, institutional and private entity; (5) they require life expectancies from a few days to several years; (6) they convey information to the viewer(s) that will span unimportant messages to critical warnings regarding health and life-threatening situations; and (7) they are located in every location and environment imaginable.

As noted above with respect to life expectancy, signs and labels, purchased for a specific end use, are expected to be legible and aesthetically suitable at a location for an appropriate length of time. As an example, a "personalized and age specific birthday banner" may require a very short life expectancy, and would not necessarily convey any type of critical message. However, in a different scenario, such as noted in number (6) above, signs or labels may display critical warnings (e.g., HIGH VOLTAGE, FLAMMABLE LIQUIDS, SAFETY VEST IS REQUIRED, and the like), and must be very evident, legible and have a life expectancy significantly longer than the birthday banner.

Certain applications for signage may require a "range" of messages with respect to criticality. For example, traffic control signs may fall within the category of informational signs, such as SCENIC OVERLOOK; WW II MEMORIAL BRIDGE, etc. Other traffic control signs may provide information which is in the form of "regulatory" facts, such as SPEED LIMIT 25 MPH; NO PARKING; HANDICAP ONLY, etc. Of greater importance are control signs which are critical in the sense that they convey life-threatening situations, such as STOP, ONE WAY, PEDESTRIAN CROSSING, CURVE AHEAD, etc. Such signage requires relatively long life expectancy, and should not be readily rendered illegible. Also, if obliterated or modified by vandalism, such signage should be capable of being quickly restored.

Signs and labels in unprotected public areas will tend to weather and deteriorate due to exposure to rain, UV radiation from sunlight, abrasion from dirt and wind, expanding and contracting due to temperature changes and damage due to vandalism. The sign and label manufacturers', and their equipment and raw material suppliers serving the sign and label industry, continually are seeking to build a "better" sign for end users. The actual cost of the sign to an end user is usually a small fraction of the total costs an end user spends to get a basic sign installed on a wall, fence or post. In addition to the initial purchase price of a sign or label, the end user incurs related acquisition costs. That is, the size, material and message have to be determined, a purchase order issued and the item received and installed. In addition, invoice and shipping costs must be paid. In view of the foregoing, the acquisition and installation (or re-installation) costs typically far exceed the price charged by the manufacturer of the sign or label. In view of these additional costs, the end user does not want to repeat the process because the sign or label becomes illegible within a short time frame. Further, the end user does not want to incur unnecessary risk, if a critical message is absent or illegible to the intended viewer.

Signs and labels (to be defined in subsequent paragraphs herein) are currently manufactured in a manner which utilizes a variety of coatings and laminates that provide a level of protection to the indicia by creating a barrier between the design layer of ink (indicia) and the environmental and human factors that can damage the article.

Turning to the drawings, FIGS. 1-5 are illustrations of certain types of signs and labels, and display prior art and common industry indicia design practices for these articles. For purposes of use of signs and labels such as those shown in FIG. 1-5, these signs and labels often must be mounted to supporting elements. For example, many signs are normally mounted to walls, fences, posts, vehicles, machines or other vertical surfaces. To mount such signs, fasteners of various types are often required. These fasteners are often required to penetrate through the substrate. Currently, for mounting of these signs, apertures are required to be formed in the substrate. In this regard, and for the signs and labels shown not only in FIGS. 1-5, but also in other drawings within the application, FIG. 17 displays a symbol used in other drawings of the application to depict a round mounting hole 10 in the substrate. Fasteners of various types may be received through the holes 10. Other types of apertures may also be required to be formed in the substrate. For example, FIG. 18 illustrates a rectangular cut out 20 used to mount a digital display or similar component. Other types of apertures may also be formed in the substrate, without departing from the novel concepts of the invention. For many signs, two or more holes 10 are normally required to "mount" the sign.

Signs that are installed on a post usually have two mounting holes 10 located along the vertical center line of the sign. One hole 10 is often located two to three inches below the top of the sign. The second hole 10 is often located two to three inches above the bottom of the sign. The positioning of the two post mounting holes 10 inevitably falls within the indicia of the signage. Other signs will often have four "corner holes" 10.

More specifically, FIGS. 1-5 display indicia designs that are commonly used by many sign and label manufacturers. The indicia designs are determined by aesthetic appeal, size, expected viewing distance, ease of printing, end user requirements and wants, along with overall cost and ease of manufacture. In the particular signage shown in FIGS. 1-5, the ink is identified as ink 30, while the substrate is identified as substrate 40.

With brief reference to these drawings, FIG. 1 illustrates a "critical" sign 100 indicating that the viewer should stop and sound a horn, and then proceed when directed. FIG. 2 is also a critical example of signage 102, indicating the presence of FLAMMABLE I-C LIQUID. FIG. 3 is an illustration of a regulatory signage article 104, indicating that a particular parking space or area is reserved for handicapped individuals. FIG. 4 is an example of signage 106 which can be characterized as being both critical and informational, with the signage 106 indicating the existence of an AIR MONITORING SYSTEM ALARM. Still further, FIG. 5 is an example of signage 110 which can be characterized as being both informational and regulatory in that the indicia of the signage 110 indicates that no pets are allowed in a designated area, with the exception of registered assistance dogs for the handicapped.

The signage 100, 102, 104, 106 and 110 illustrated in FIGS. 1-5, and other known indicia designs, are developed based on criteria primarily driven by the following:

1. Regulatory standards.
2. End user specifications.
3. Graphic designers.
4. Manufacturing costs.
5. Printing technology capabilities.
6. Raw materials (substrates).
7. Production rates.
8. Visibility.

The durability and longevity of the article is typically determined by the material selected for the substrate, and the coating (or laminate) applied to the article post-printing without regard to the indicia design. The images illustrated in FIGS. 1-5 display indicia designs that require printing to the edges of the article and/or in regions that initially have or will have an opening formed therein. Any or all of the referenced images may have a coating or laminate applied to protect the printed image. The value and strength of a protective coating or laminate is largely determined by the ability of the protective layer to bond to the substrate. Indicia designs with no bare substrate preclude any of the protective layer from bonding to the substrate. The protected layer only bonds to the ink layer forming the indicia, and relies completely on the adhesion strength of the ink to prevent delaminating.

Indicia designs that have ink along the outside edges of the article and/or on the interior edge of an opening create exposed ink layer along edges and openings to the environment. The exposed edges of the ink layers are the weak points on the article. The exposed ink layer edges are especially susceptible to delaminating, since the adhesive strength is reliant on the weaker ink adhesion versus the stronger bond provided by the protective coating. As will be described in subsequent paragraphs herein, the invention purposely designs indicia with bare substrate surfaces along the periphery of the article and around and within openings within interior areas of the article to preclude incipient delamination along these edges and to take advantage of a protective layer's superior bonding strength to the bare substrate.

As earlier described, signs and labels are required to be installed and remain functional in a variety of environments and over an extended period of time. For a sign or label to be functional, the intended viewer must be able to easily and quickly see and understand the message. Basic to achieving functionality is maintaining the legibility and original appearance (e.g., color, contrasting colors, completeness, etc.) of the sign or label. Properly designed indicia on signs and labels with a properly applied polymeric layer will significantly extend the useful life of signs and labels by protecting the design layer and enabling quick and/or aggressive cleaning, without deterioration of the article. Labels and signs designed with the bare edge and bare openings borders have superior characteristics, so as to maintain the original protective and cleaning properties over an extended time, even after exposure to harsh environments (UV rays from sunlight, wind and/or multiple cleanings).

SUMMARY OF THE INVENTION

In accordance with the invention, a method is used for manufacturing, in part, certain articles which may be in the form of signs and labels used to convey information and messages to single or multiple viewers. The term "signs and labels" is used in a broad sense in the description and definition of the invention covered by this application, as described within the section titled "Detailed Description of the Invention." A method utilized for manufacturing these articles in accordance with the invention maximizes and extends the useful life of the articles by defining indicia design criteria for signs and labels that will be encapsulated between the protective surface coating and the substrate. The protective properties afforded by the layering of polymeric materials onto the surface of the article will extend the life expectancy of the article, while providing the ability to restore the article by cleaning. The resultant article of the invention, namely a sign or label with fully encapsulated indicia between the protective surface layer and substrate is produced using current printing technologies. Further, the methods in accordance with the invention utilize, in part, existing methods of surface coating substrates with a UV curable liquid monomer, curing the monomer to a clear polymer by UV radiation, and adding appropriate designed indicia in a manner so as to have no exposed ink surfaces or on any edges.

Further in accordance with the invention, a method is provided for enhancing and extending the integrity and useful life of an article of manufacture. The article is in the form of a sign or label comprising a substrate formed on a planar surface area having any one of a series of shapes, thicknesses and sizes and may be rigid or flexible. The method includes the step of forming a design layer with inks applied to the substrate in a predetermined pattern so as to convey visual information to a viewer. When the inks are applied to the substrate, the process refrains from applying any of the inks to one or more edges formed around the periphery of the sign or label. This provides for a bare edge border. A protective coating is then applied over the inks so as to provide a protective cover. Further in accordance with the invention, the process includes continuing the application of the coating so that the coating fully covers not only the design layer, but also the edge borders formed on the substrate where the developer has refrained from applying the inks. The protective coating and substrate fully encapsulate the indicia between the protective coating and substrate leaving no ink surfaces (indicia) exposed to the environment.

In accordance with further concepts associated with the invention, the liquid monomer has properties which allow application to substrates of various materials, sizes, thicknesses, colors and textures. The liquid monomer's properties allow application to substrates at a high volume production rate, without the need for post-encapsulation steps of trimming or otherwise removing tags. The protective coating is an acrylate polymer that is directly bonded to the substrate and indicia surfaces during the curing process and encapsulates the indicia between itself and the substrate.

In accordance with other concepts of the invention, a process includes the forming of at least one mounting hole within the sign or label, comprising an opening for the use of one or more screws, bolts, or other connection means. When applying inks to the substrate so as to form the design layer, there is a refraining from application of any of the inks to adjacent sides or edges which form a periphery around the mounting hole. In this manner, an opening will have an absence of ink (indicia) near the edges, thereby forming a bare border around any opening in the article. The protective coating is applied over the inks and also over the opening bare border formed on the substrate where the developer is refrained from applying the inks. In accordance with the invention, direct contact of the protective coating to the substrate along the edge of the mounting hole creates a substantially increased resistance to delaminating from pressure washing, moisture, chemicals, high temperatures, poor ink adhesion, and mechanical forces.

Further in accordance with the invention, the article of manufacture can include a series of mounting holes, with certain of the holes being positioned so as to be substantially fully enclosed by the inks, but with an absence of ink (indicia) around each of the holes thereby forming a bare border enabling the protective coating to bond directly to the substrate in these regions. In accordance with other concepts of the invention, mounting holes can be positioned at a series of corners of the article of manufacture, with each of the mounting holes having an unprinted area forming the bare border therearound, where the bare border is contiguous with at least one edge bare border around the perimeter of the article. The liquid monomer can be applied to the article of manufacture so that after curing the protective coating fully covers not only the design layer, but also all of the edges of all bare borders.

In accordance with other concepts of the invention, an article of manufacture can be in the form of a label having a pressure sensitive adhesive backing, with a substrate formed on a substantially planar surface area having any of a number of shapes, thicknesses and sizes. A method of formation of the article of manufacture can include the application of the inks to the substrate, and refraining from applying any of the inks to sides or edges which form a periphery of the label. The protective coating is applied so as to provide not only a protective cover to the design layer, but also to the edge borders formed on the label where the developer has refrained from applying the inks.

In accordance with further concepts of the invention, an article of manufacture is formed with a design layer having inks or similar materials, a substrate supporting the inks and a protective coating formed over the inks so as to form a protective cover. The substrate has one or more edges formed around a periphery of the sign or label, with the edges forming a bare edge border. Inks are absent from the bare edge border, but the protective coating is formed over the bare edge border.

BRIEF DESCRIPTION OF THE DRAWINGS

The invention will now be described with reference to the drawings, in which:

In FIG. 2 four corner holes 10 are positioned within the indicia 30. Ink is printed to the edges of the holes 10, and to the outside edges of the substrate 40.

FIG. 5 displays the least desirable indicia design to create a protected coating over the ink layers. Incipient delaminating can begin along the edges of the article 110, and at the locations of the holes 10.

FIG. 6 displays the bare regions of substrate 40 that are necessary to achieve full encapsulation of the ink layer 30 forming the indicia between the protective layer and substrate. Both the border of the article 112 and borders of each opening have bare surfaces, so as to attain the full encapsulation of the indicia 30 between the protective layer and substrate. More specifically, FIG. 6 includes two post holes 10 within the indicia 30. Unlike certain prior art, the indicia 30 is not printed to the edge of the two post holes 10. Bare borders 132 are at each mounting hole opening 10 and bare borders 130 are provided around a periphery of the article 112.

In FIG. 11, six indicia are ganged on a single sheet of substrate 40 for printing and subsequent cutting into individual articles.

FIG. 12 illustrates the final shape of the article 124 with openings in the corners to be used as mounting holes 10.

DETAILED DESCRIPTION OF THE INVENTION

Figure 1:
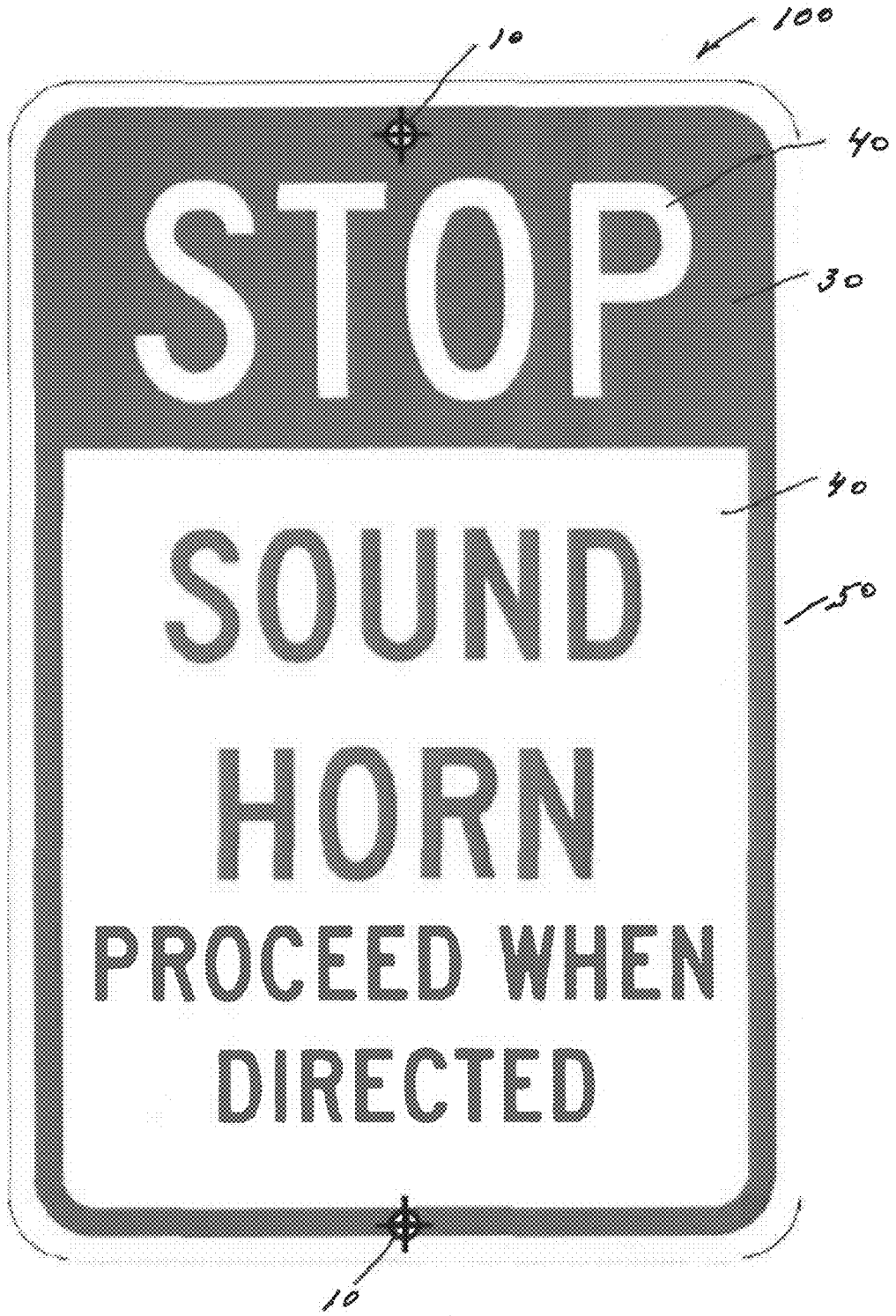
Fig. 1 (Prior Art)
FIG. 1 is an elevation view of a prior art sign 100 falling within critical and warning categories, and having two post holes 10 positioned within the indicia 30. Also, ink is printed to the edge of the post holes 10, and a bare border 50 is provided.
Figure 2:
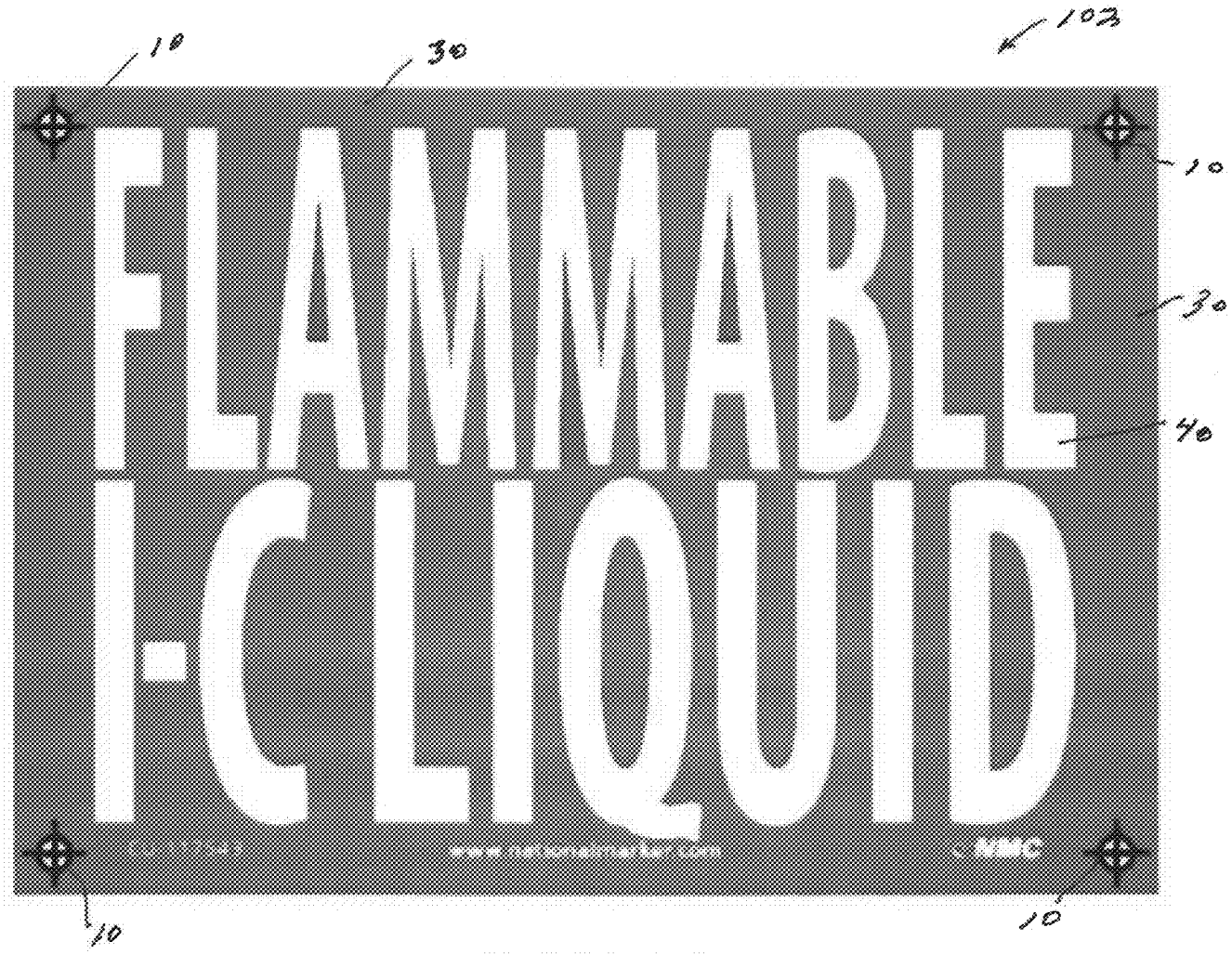
Fig. 2 (Prior Art)
FIG. 2 is an elevation view of a prior art critical example of signage 102.
Figure 3:
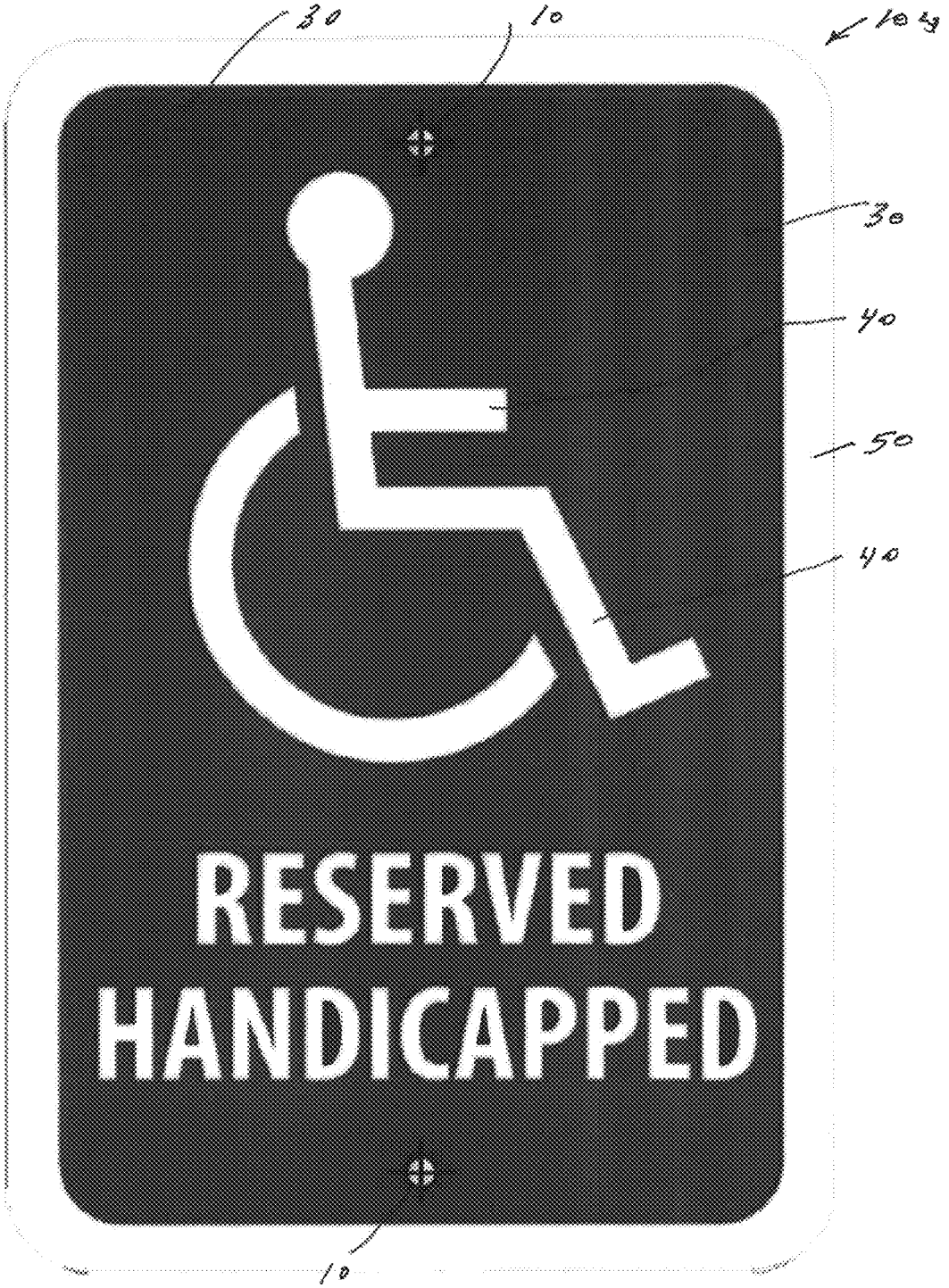
Fig. 3 (Prior Art)
FIG. 3 is an elevation view of a prior art signage article 104 falling within the scope of regulatory signage. Two post holes 10 are provided within the indicia 30, and ink is printed to the edges of the holes 10. The signage article 104 includes a bare border 50.
Figure 4:
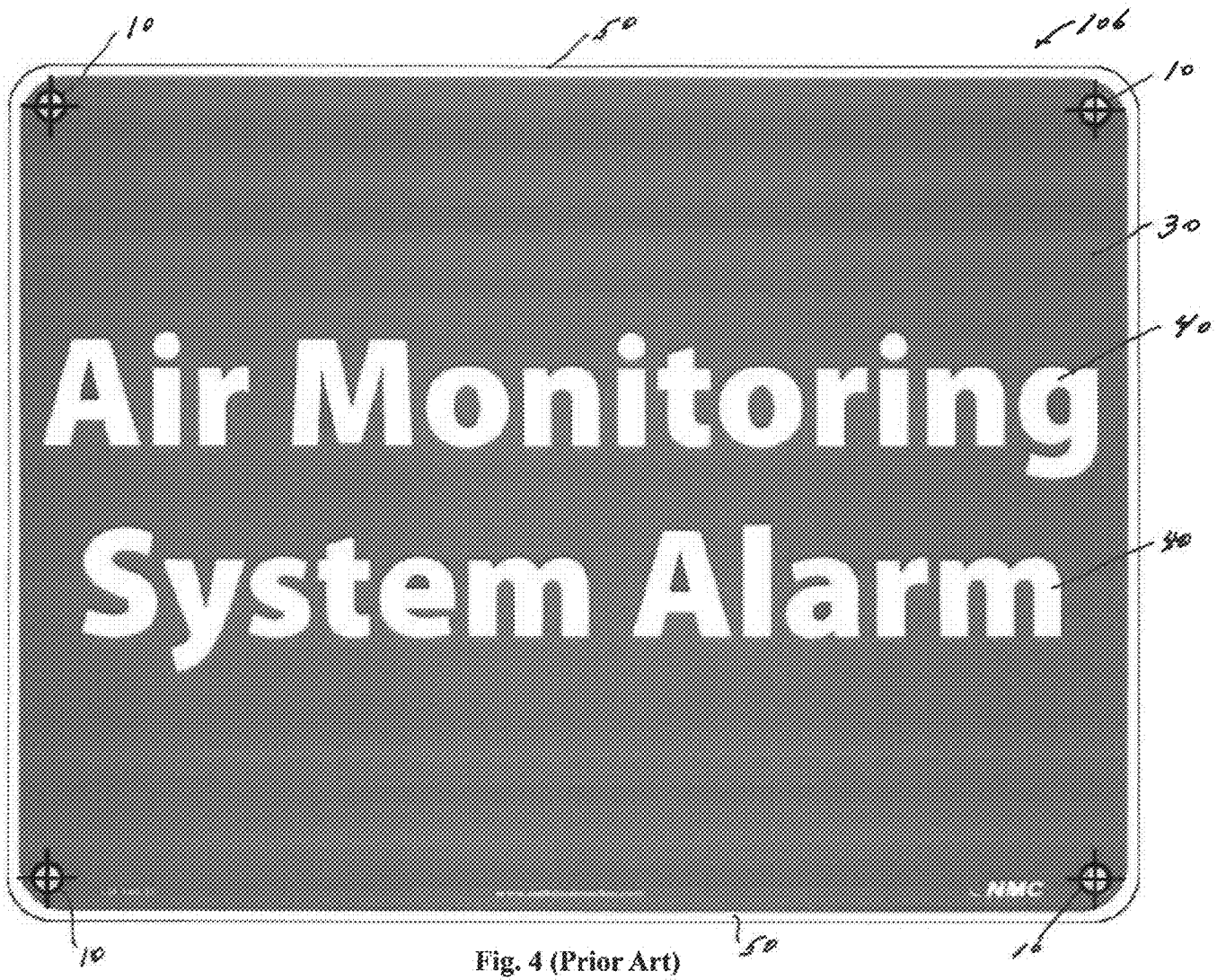
Fig. 4 (Prior Art)
FIG. 4 is an elevation view of a prior art signage article 106, falling within the scope of both critical and informational categories. The signage article 106 includes four corner holes 10 within the indicia 30. Ink is printed to the edges of the holes 10, and a bare border 50 is provided.
Figure 5:
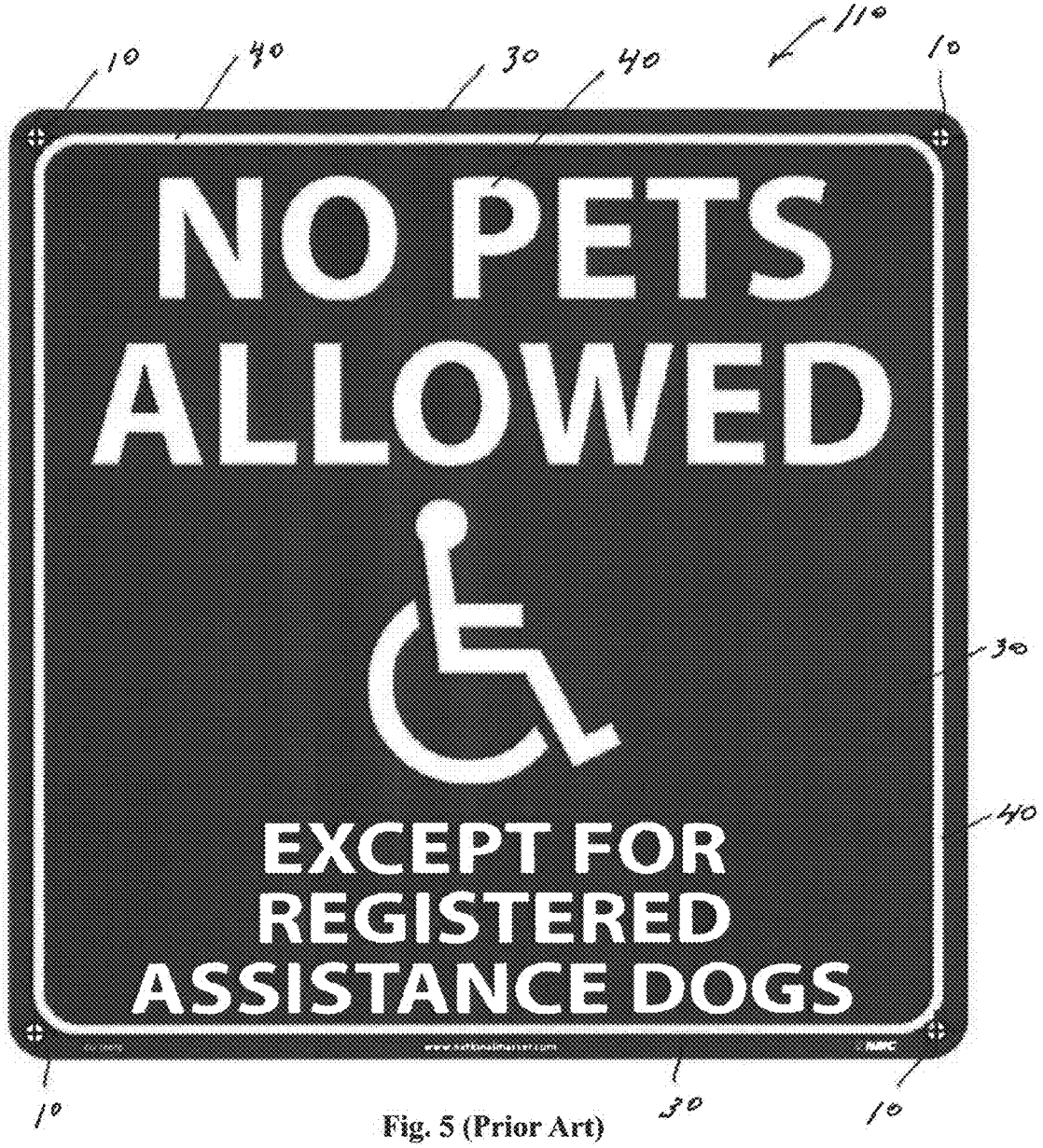
Fig. 5 (Prior Art)
FIG. 5 is an elevation view of a prior art signage article 110 falling within the scope of both informational and regulatory categories. Four corner holes 10 are provided within the indicia 30. Ink is printed to the edges of the holes 10. Also, ink is printed to the edges of the substrate 40.

The principles of the invention will now be described with respect to indicia designs and methods in accordance with the invention that fully encapsulate the inks forming the indicia between the protective costing and substrate as illustrated primarily in FIGS. 6-13. For describing the types of articles which may be produced by practicing the methods of the invention, the term "signs," "labels," and "signs and labels" will be utilized in this application to describe a broad spectrum of articles which may be used to convey information and messages to single or multiple viewers. This spectrum of articles may include, but are not necessarily limited to: Signs, labels, posters, banners, stencils, cards, badges, marks, way finding, tags, directional, emblems, decals, stencils and name tags. Accordingly, it should be understood that articles and methods for producing such articles in accordance with the invention are not limited to the specific articles described and/or illustrated in this application.

As described in subsequent paragraphs herein, and in accordance with the invention, the useful life of an article is substantially extended (and may even be characterized as "maximized") by defining indicia design criteria for signs and labels that will be fully encapsulated between a protective coating and substrate. That is, the protective properties afforded by the layering of polymeric materials onto the surface of the article will extend the life expectancy of the article, while providing the ability to restore the article by cleaning.

As previously described herein, signs and labels which are currently manufactured use a variety of coatings and laminates that provide a level of protection to the indicia by creating a barrier between the design layer of ink and human factors that can damage the article. In accordance with the invention, the articles are designed and manufactured such that the plurality of indicia including any broader areas making up a background color are fully encapsulated between the protective coating and the substrate. Critically, no ink is exposed either in a planar or "sideways" direction to the sign along all edges. Although the invention provides for a significant advantage over the prior art, the invention takes advantage of a number of known processes and design attributes. For example, fully coated signs and labels in accordance with the invention can use some current printing technologies, and certain existing methods of surface coating substrates with a UV curable liquid monomer. Further, the monomer can be cured so as to produce a clear polymer by UV radiation. Properly designed indicia associated with the article will have no exposed ink surfaces or edges.

To more explicitly define concepts associated with the invention, the product designs and methods in accordance with the invention fully encapsulate and thereby protect a design layer of ink, indicia on plastic, metal, paper, or other ink receptive substrates. The indicia can be designed so that the desired image will not extend to any edge of the substrate, thereby leaving unprinted, ink-free, bare border on the peripheral of the substrate and surrounding any openings such as mounting holes and cut outs for digital displays within the interior areas of the substrate. The liquid polymerizable monomer is applied to the surface of the article, covering 100% of the ink forming the design layer and all bare areas of the substrate. The article is then immediately transferred to the UV curing station, where the article is passed under high intensity UV radiation lamps. The liquid monomer is then immediately cured, creating a transparent cross-linked polymer that fully covers the face of the sign and encapsulates the design layer of ink sites between itself and the substrate, by bonding to the substrate along the bare edge borders and bare opening borders on the article without use of a layer of adhesive.

FIGS. 6-13 display indicia that are specifically designed so as to provide bare substrate regions around the periphery of the article, and around pre or post formed openings within the interior region of the article. FIGS. 6-10 display a single finished article, while FIG. 11 displays an example of semi-finished goods utilizing proper indicia designs. All openings and edge regions have bare substrate surfaces, so as to allow the protective polymer layer to fully encapsulate the ink layer between the protective coating and substrate.

Figure 6:
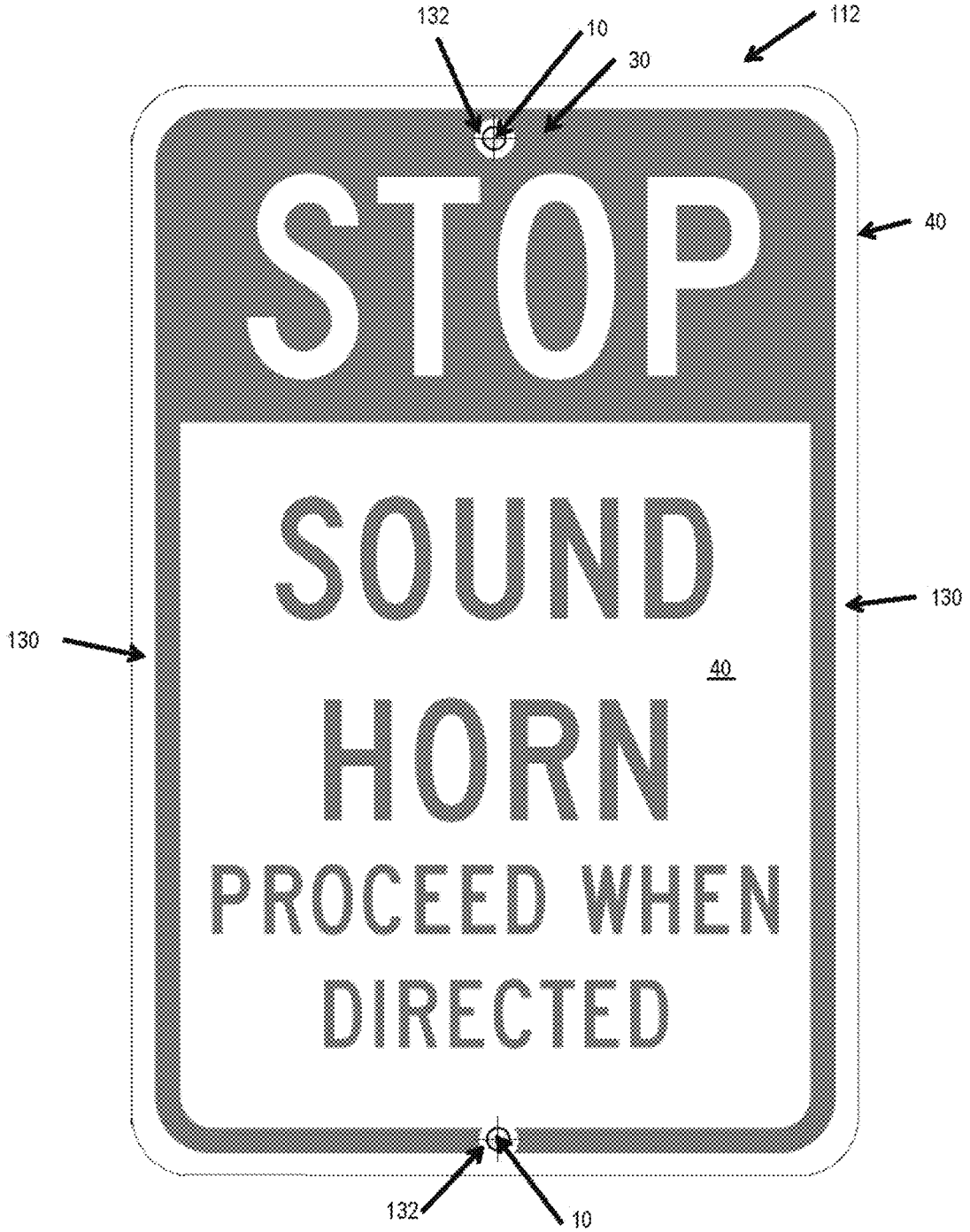
FIG. 6 is an elevation view of a signage article 112 produced in accordance with the invention, and falling within the scope of critical and warning signage articles.

As earlier described, FIG. 6 is a view of a signage article 112 produced in accordance with the invention. As shown in FIG. 6, the article 112 includes two post holes 10 positioned within the indicia 30. It should be noted that the indicia 30 is not printed to the edge of the two post holes 10. Instead, there is a bare border, or what can be characterized as an openings bare border 132 surrounding each of the post holes 10. Further, bare borders also exist in the form of edge bare borders 130 positioned around the four edges and periphery of the article 112. FIG. 6 has the identical "message" as FIG. 1, and some of the same locations of the mounting holes 10. The intentional bare border areas 130 and 132 distinguish an indicia design that can fully encapsulate indicia between the protective coating and substrate from designs that create ink layers around openings and along the outside edges of the article 112.

Figure 7:
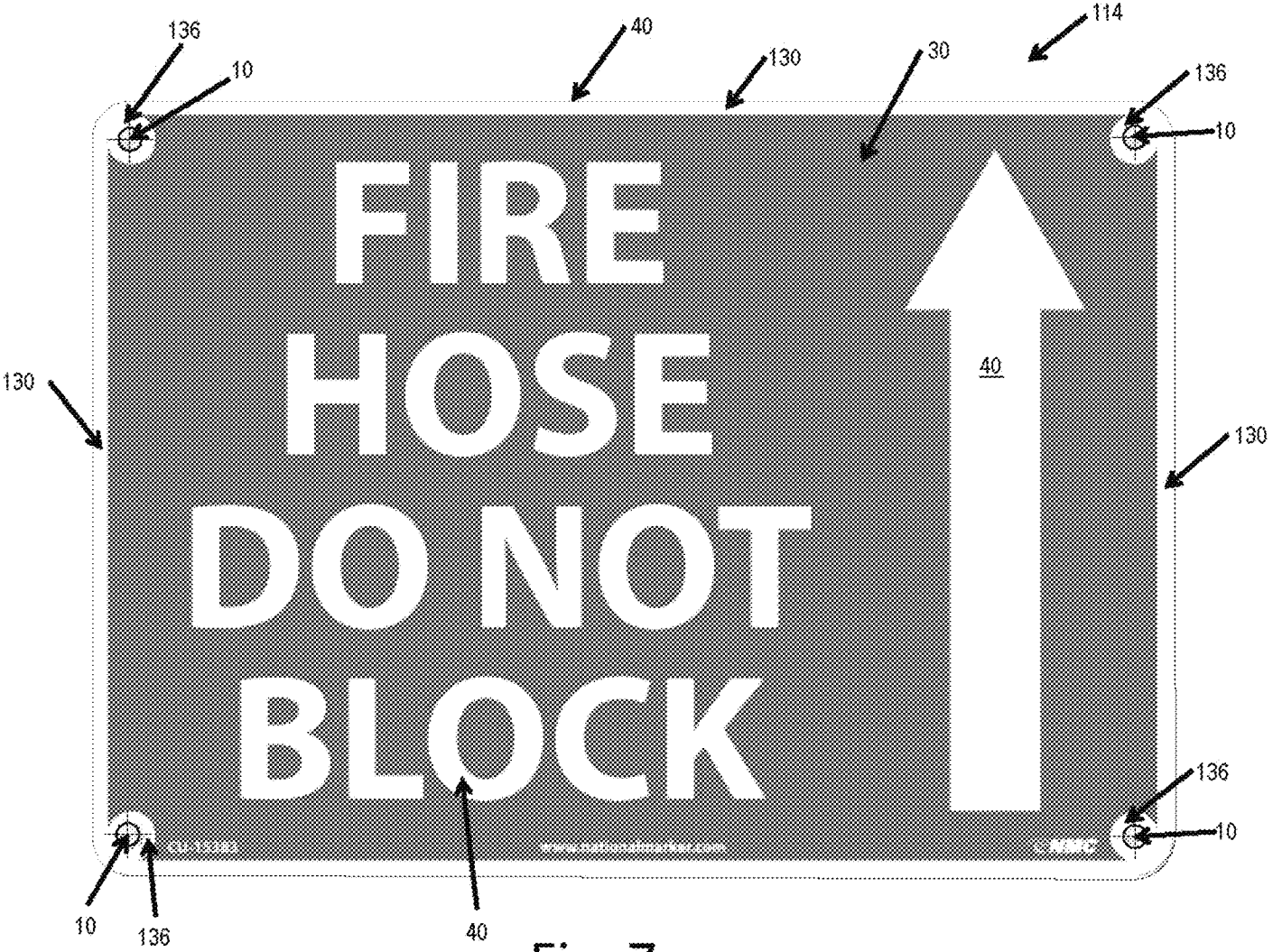
FIG. 7 is an elevation view of another signage article in accordance with the invention, identified as signage article 114. The signage article 114 falls within the scope of critical and warning categories.

As also previously described with respect to the description of the drawings, FIG. 7 is an elevation view of another signage article 114 in accordance with the invention. Signage article 114 includes four corner holes 10 positioned within the indicia 30. As apparent from FIG. 7, ink is not printed to the edge of the holes or openings 10. Instead, openings bare borders 136 exist between the ink 30 and the holes 10. Further, bare borders or edge bare borders 130 exist along the periphery of the article 114. This generation of openings bare borders 136 and edge bare borders 130 distinguish indicia which is designed so as to be fully encapsulated in accordance with the invention.

Figure 8:
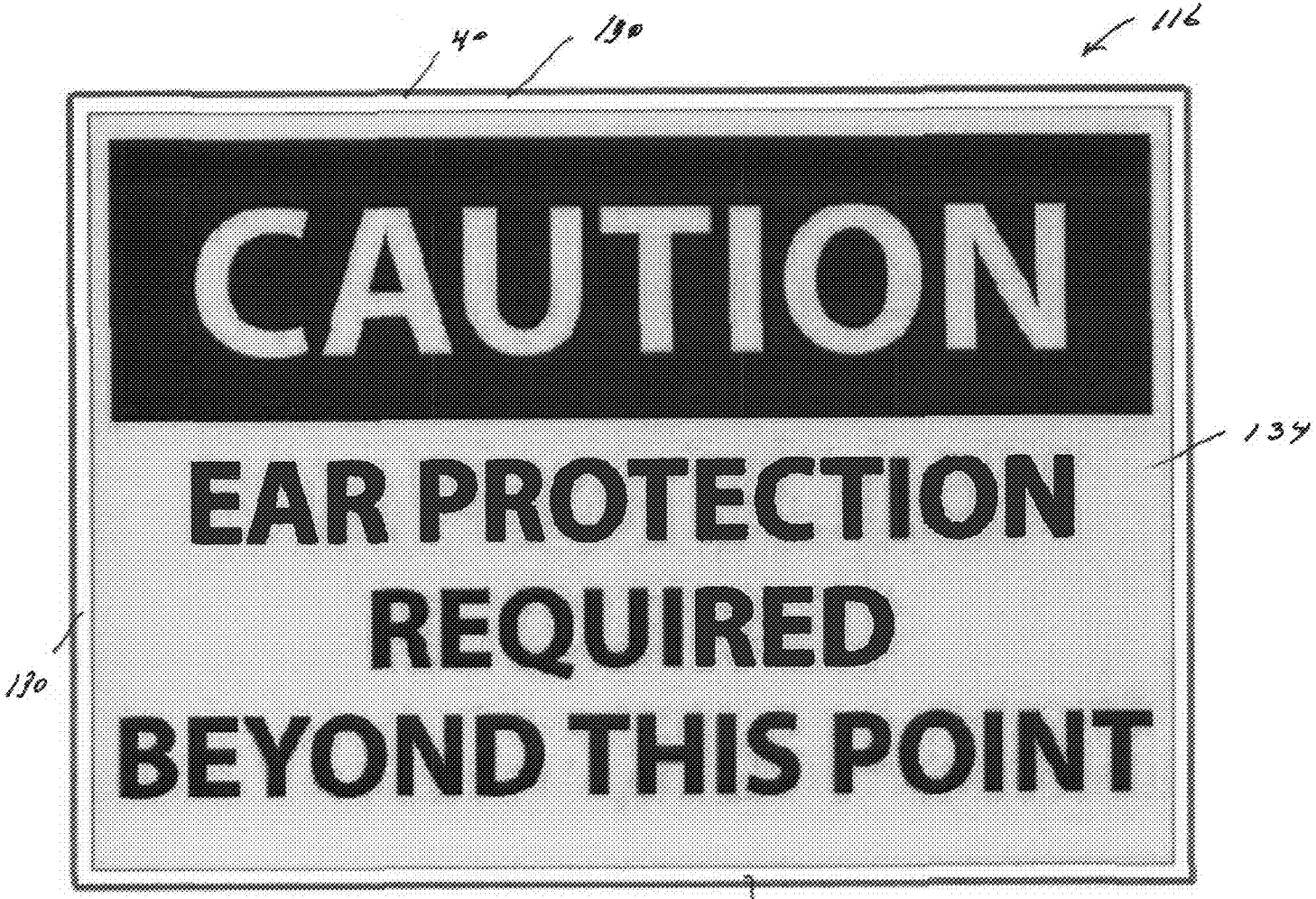
FIG. 8 is an elevation view of a signage article 116 manufactured in accordance with the invention. The signage article 116 falls within the categories of both critical and warning attributes.

FIG. 8, unlike the articles 112 and 114 as illustrated in FIGS. 6 and 7, respectively, is an elevation view of an article 116 which is in the form of a vinyl label 134. Although article 116 is a vinyl label, the label is produced in accordance with the invention. That is, a bare border or edge bare border 130 extends around the periphery of the label 134. This border 130 forms the bare encapsulation area for the article 116. Indicia within the article 116 is designed so as to be fully encapsulated between the protective coating and substrate. It is noted and apparent that the article 116 comprising the vinyl label 134 requires no mounting holes.

Figure 9:
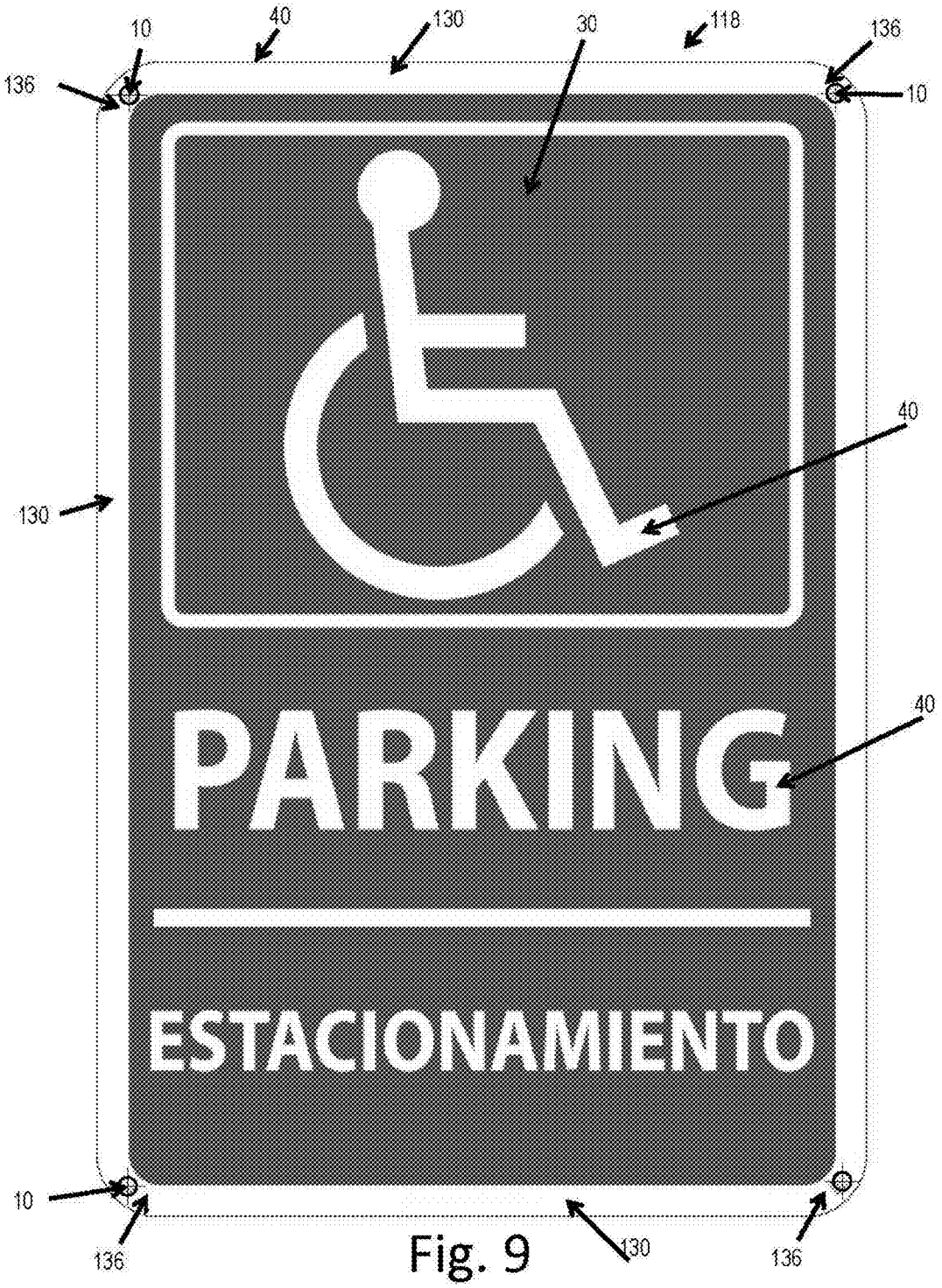
FIG. 9 is an elevation view of a further signage article 118 manufactured in accordance with the invention. The signage article 118 falls within the scope of a regulatory category, and includes written information in multiple languages.

FIG. 9, as previously and briefly described herein, is an elevation view of a signage article 118 also manufactured in accordance with the invention. The article 118 represents a relatively clean and efficient indicia design that enables full encapsulation of the design layer between the protective coating and substrate. As illustrated in FIG. 9, the design places four mounting holes or openings 10 within what can be characterized as bare and open regions of the edge border 130. In this particular instance, article 118 includes the four mounting holes 10 at each of the corners of the rectangular article 118. The holes 10 are shown as being positioned within what can be characterized as openings bare borders 136. The borders 136 surround each of the individual holes 10, but are located within the edge bare borders 130.

Figure 10:
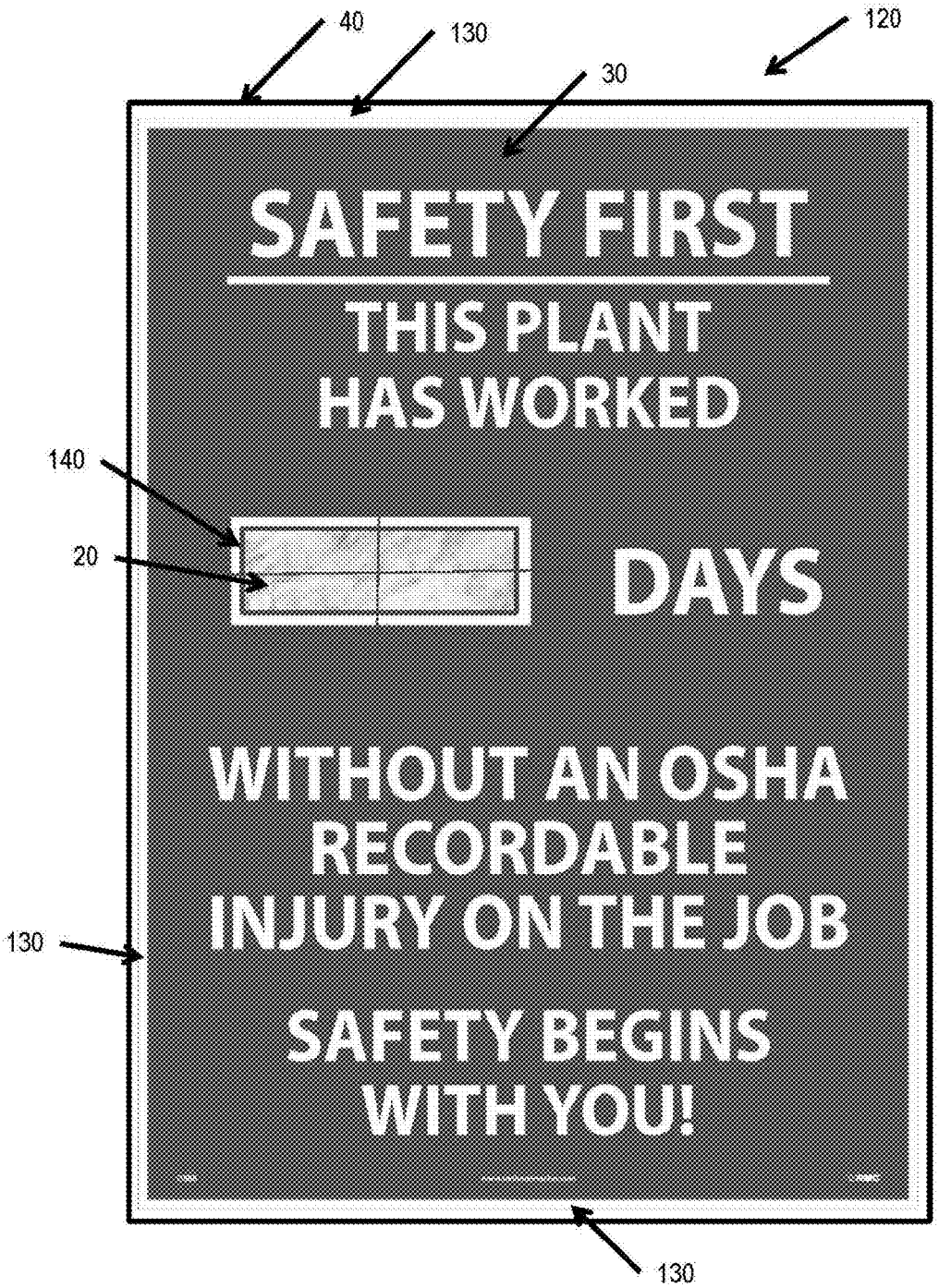
FIG. 10 is an elevation view of a signage article 120 manufactured in accordance with the invention. The signage article 120 falls within an informational category, with incentive language for maintaining safety during job performance.

As also previously described, FIG. 10 is an elevation view of a signage article 120 in accordance with the invention. The signage article 120 falls within categories which could be characterized as informational and incentivizing. Article 120 illustrates a bare substrate area 140 around a rectangular opening 20 which is used for mounting a digital display around the bare substrate area 140. A bare border or edge bare border 130 is maintained around the entirety of the periphery of the article 120. It should be noted that no mounting holes are utilized with article 120.

Figure 11:
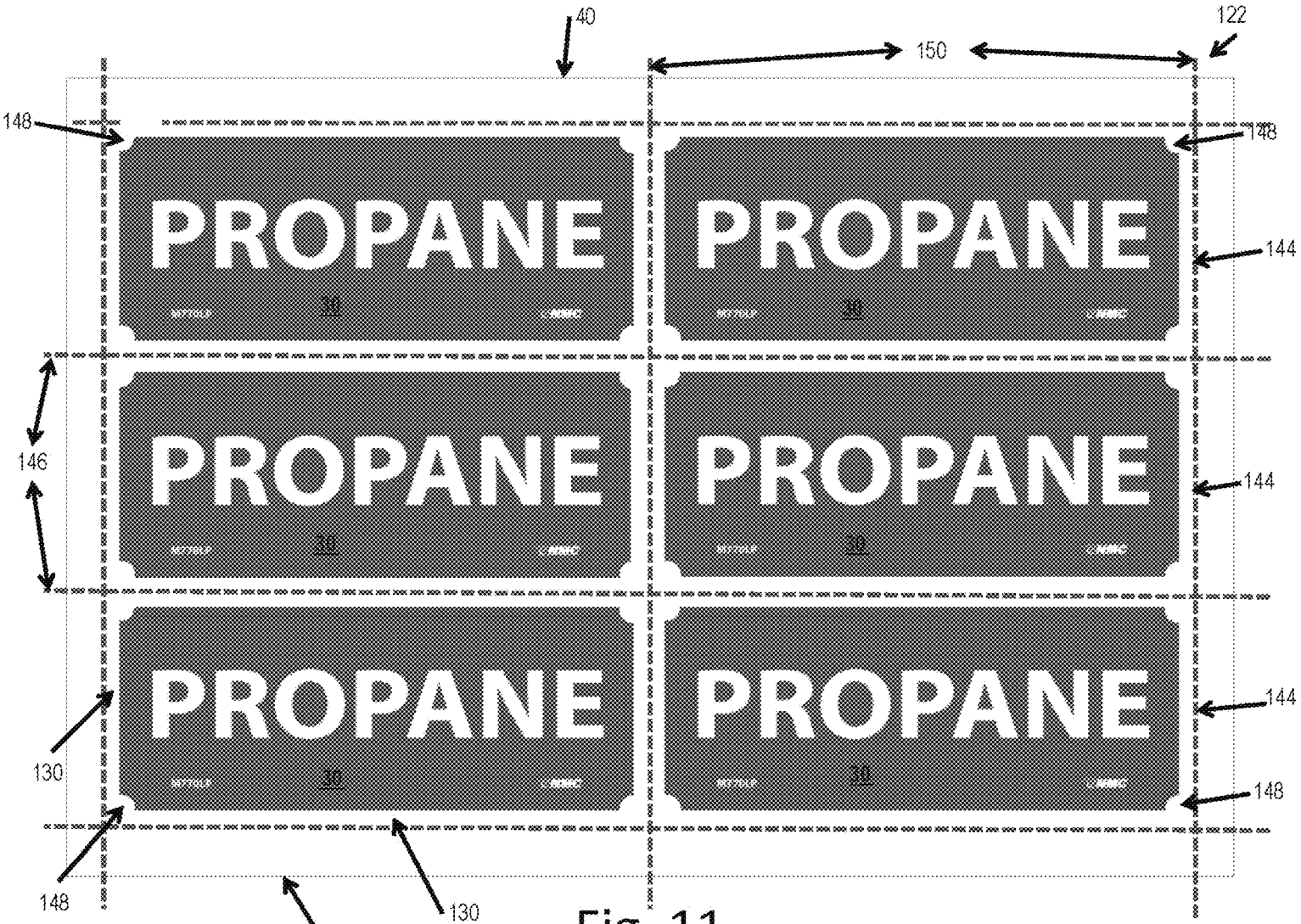
FIG. 11 is an elevation view of an example "layout" of indicia design for articles 122 that are printed in a quantity greater than one on a common sheet or roll of substrate 40.
Figure 12:
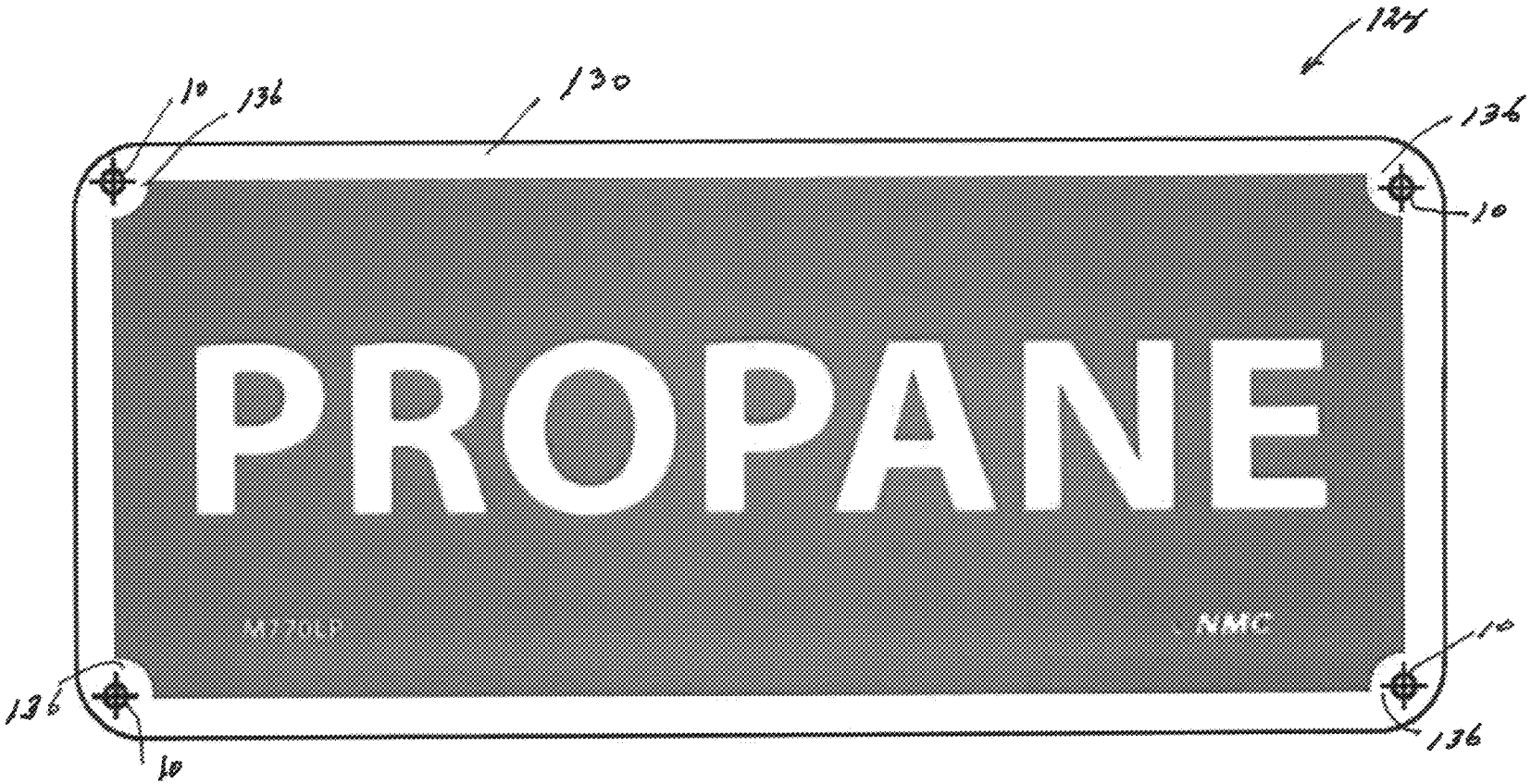
FIG. 12 is an elevation view of a finished article 124 which was shown in FIG. 11 as a group of six printed images on a common substrate.

FIG. 11 is an elevation view of an example "layout" of indicia designed for an article 122 which consists of a series of articles 144 printed in quantities greater than 1 on a common sheet or roll of substrate 40. In FIG. 11, the articles 144 consist of labels or signs which can be commonly printed on rolls of flexible or rigid substrate 40 which may range from 24 inches to 120 inches wide, and 10 to 100 yards long. Sheet sizes for these types of articles are typically in the range of 48 inches by 96 inches, and smaller. Manufacturers of signs and labels frequently put multiple images on a single sheet or roll of material, so as to gain efficiencies in printing and handling. The application of the liquid monomer and subsequent UV curing is more efficiently accomplished for smaller sized articles by ganging several of the same on a sheet or roll. The images may all be identical (as in FIG. 11) or a mixture of several sizes and designs. Identical and mixed combinations of indicia may be in the "layout" created by the prepress designer. FIG. 12 illustrates the finished article after cutting and forming mounting holes.

More specifically, FIG. 11 illustrates six indicia 144 in the form of labels which are ganged on a single sheet of substrate 40 for printing and subsequent cutting into individual articles. Openings, for the particular embodiment illustrated in FIG. 11, may consist of four corner holes which will be formed at the locations 148 also illustrated in FIG. 11. In addition, FIG. 11 illustrates a dimension 146, which primarily consists of the height of one label 144 and a pre-determined amount of substrate as an edge border 130. The dimension 146 provides for an allowance for kerf width. Similarly, a dimension 150 is also shown in FIG. 11, essentially comprising the width of one of the labels 144, plus a pre-determined amount of substrate 40. Again, this distance 150 provides for an allowance for kerf width. FIG. 11 illustrates six indicia 144 ganged on a single sheet of substrate for printing and subsequent cutting into individual articles. Openings in this particular embodiment consist of four corner holes which will form post-cutting at locations 148.

Further with respect to FIG. 11, the edge border 130 will have bare substrate areas incorporated into the design that will result in edge and opening bare regions, after the articles have been separated into individual pieces and all openings (such as mounting holes) have been made in the substrate 40. Separating the images into single articles may be done by saw cutting, guillotining, routering, knife cut, shearing, kiss cutting, laser, die cutting, water jet and other methods. Dependent upon the post-cutting method and kerf width, the indicia and prepress designers can arrange the images on the sheet or roll so as to allow ample spacing for kerf width, such that the edge and all openings retain the integrity of encapsulation borders. For purposes of explanation, and specifically with respect to "kerf" width, the term "kerf" is typically defined as the width of the material that is removed by a cutting process. It was originally used to describe how much wood was removed by a saw, because the teeth in the saw were bent to the side. Therefore, they removed more material than the width of the saw blade itself. When related to CNC shaped cutting with typical cutting processes, kerf is typically referred to as the width of material that the process removes as it cuts through the plate.

FIG. 12 is an elevation view of a finished article 124 which was shown in FIG. 11 as a group of six printed images (identified as article 144 in FIG. 11) on a common substrate. FIG. 12 displays the final shape of the article 124, and also shows four openings or holes 10 positioned at the four corners of the article, to be used as mounting holes. Further, the article 124 has a continuous unbroken bare border around the periphery (in the form of border 130), and bare areas 136 around the corner holes 10. The bare areas 136 can be characterized as openings and edge bare borders. The article 124 will preferably be printed, liquid coated and UV cured prior to the functions of cutting, rounding the corners, and forming the corner holes 10. In this particular use of methods in accordance with the invention, the cut lines and corner hole locations were intentionally located by graphic and prepress layout designers, so as to maintain the required bare substrate areas post cutting and forming operations so as to avoid non-encapsulated ink along any of the edges.

Figure 13:
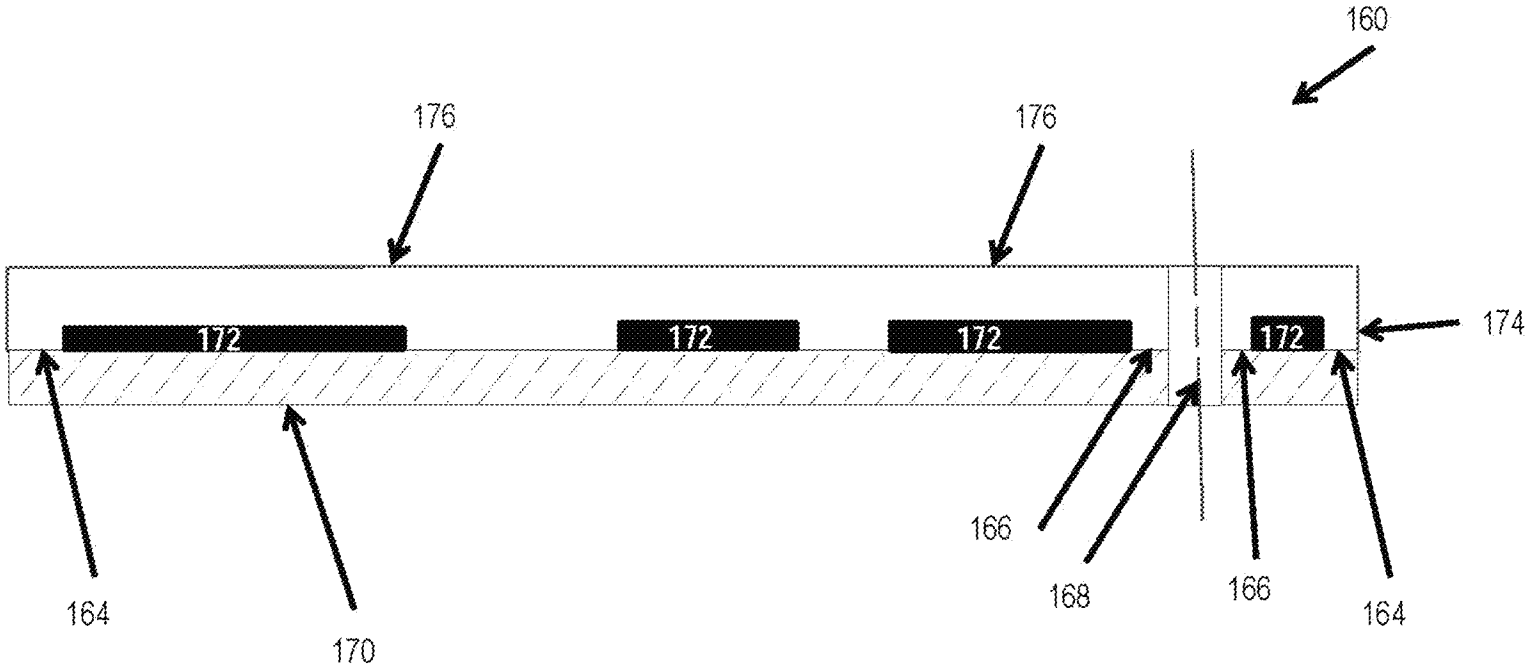
FIG. 13 is a cross-sectional view of a sign or label 160 using surface encapsulation in accordance with the invention so as to protect the inks forming the design layer.

FIG. 13 is a cross-sectional view of an article 160 (in the form of a sign or label) which exemplifies a product in accordance with the invention, and a method of producing the product in accordance with the invention. Specifically, FIG. 13 illustrates article 160 using the encapsulation process to protect the inks forming the design layer. The edges of the article 160 and areas around the mounting holes 168 are bare. For purposes of description of FIG. 13, the inks forming the design layer are identified as inks 172 and are shown in a solid color. Correspondingly, the substrate 170 supporting the inks 172 is shown by the cross-hatched rectangle. The mounting hole 168 is shown near the right edge 174 of the article 160. The protective coating, 176 is shown in clearer rectangular form containing the darkened rectangles directly above the substrate 170. FIG. 13 is substantially representative of the principal concepts of the invention, whereby a protective coating fully encapsulates a plurality of ink sites between itself and the substrate. The invention embodied within FIG. 13 represents the synergistic effect of indicia designs that do not apply ink near any edge of the substrate, and utilizing a UV curable monomer that has bonds well to a broad range of materials and inks. The concepts in accordance with the invention also envision utilizing an liquid monomer with multiple protective and barrier properties, and with the ability to be applied onto printed substrates of various sizes, thicknesses, colors and textures at high volume production rates, without the need for post production steps to trim or remove tags.

More specifically, the direct contact of the protective coating 176 to the substrate 170 along the edge of the article 160 creates relatively maximum resistance to delaminating from pressure washing, moisture, chemicals, high temperatures, poor ink adhesion and mechanical forces. The openings bare borders 166 and bare edge borders 164 are displayed in FIG. 13 next to the mounting hole opening and at the extreme left and right hand ends of article 160. Still further, with respect to mounting holes, direct contact of the protective coating 176 to the substrate 170 along the edge of mounting hole 168 creates maximum resistance to delaminating which can result from the same actions previously described with respect to contact of the protective coating with the substrate along the edge of the article. Still further, it is re-emphasized that articles surface encapsulated which may be in accordance with the invention are not limited to those having mounting holes in a "round" configuration. That is, the mounting holes or openings may be of any size or shape.

Figure 14:
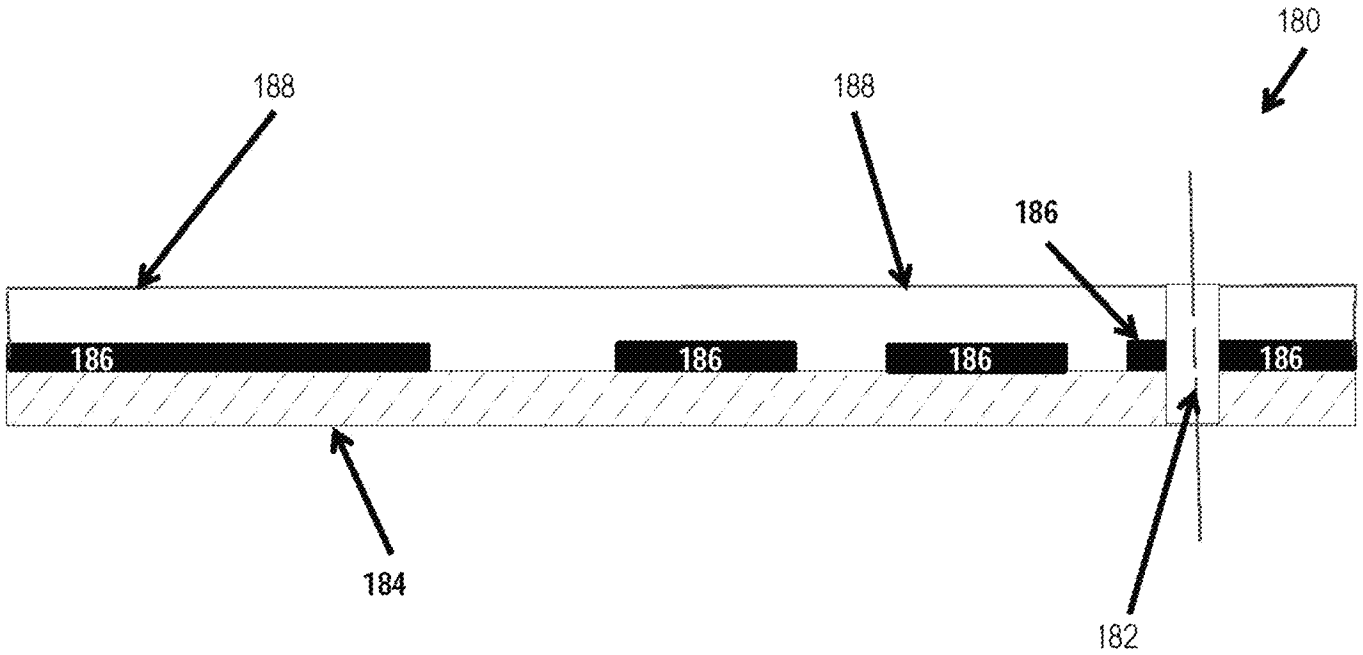
FIG. 14 is a cross-sectional view of a typical sign or label 180 which is not using an edge-to-edge encapsulation between the protective coating and substrate to protect the inks forming the design layer or image.

In contrast with FIG. 13, FIG. 14 is a cross-sectional view of an article 180 in the form of a sign or label which does not use any type of indicia encapsulation in accordance with the invention. Specifically, there is no edge-to-edge protective coating to protect inks forming the design layer. As shown in FIG. 14, the article 180 includes a substrate 184. A mounting hole 182 is also provided. Inks forming the design layer are illustrated as inks 186.

A number of properties (or lack of properties) should be noted with respect to the article 180 illustrated in FIG. 14. First, the inks 186 are represented by black rectangles, and the substrate 184 is represented by the cross-hatched rectangle. The protective coating 188 is represented by the clear rectangle containing the black rectangles directly above the substrate. A mounting hole 182 is shown with an ink layer 186 applied to and directly abutting the edge of the mounting hole opening 182.

FIG. 14 illustrates a relatively commonly used indicia design, where the inks extend to the edges of the substrate and across openings. The ink may be printed edge-to-edge and over openings, or the substrate may have been trimmed/drilled in a post operation using the same effect. The ink along the edge of the article 180 and surrounding any openings precludes a protective layer encapsulating the ink between the protective layer and substrate itself, and leaving an exposed edge of the ink layer that can be the site for incipient delaminating. Using indicia designs as displayed in FIGS. 1-5, the protective layer is not forming a complete seal around the design layer, and not adhering to the substrate along the edges and around openings in the substrate.

More specifically, and again with reference to FIG. 14, there are no edge or openings bare borders. There are no openings bare borders surrounding the mounting hole. There is no edge-to-edge contact (bonding) by the protective layer to the substrate. Maintaining the integrity of the three layers along the edges and openings is dependent on the ink's bonding strength to the substrate, relative to the stronger bonding strength of a UV curable polymeric layer. Further, incipient delaminating can occur at edges and around openings due to pressure washing, moisture, chemicals, high temperatures, poor ink adhesion or mechanical forces.

It is worthwhile to again note that many terms in this Application may be used interchangeably. For example, the terms indicia, design layer, image, artwork, design, legend, message, graphic design, and copy are used interchangeably, and all refer to the image created by applying inks and/or paints to a substrate. The image may consist of letters, numerals, pictograms, photo images, graphics, symbols, drawings, multi-lingual, background colors and other colors or markings used individually or in any combination. Still further, without departing from the scope of the invention, the images may be monochromatic, multiple colors, and grayscale. In addition, an identical image or a second differing image may be printed on the reverse or the back of a substrate. The second image can be designed in such a manner so as to follow all criteria as defined for the "front side" image, so as to achieve encapsulation of the design layer between the protective coating and substrate.

Further, the finished size (e.g., height and width) of the article may be formed prior to or post printing. Also, the finished sides of the article can be formed prior to post-application of the liquid monomer and curing operations.

In accordance with other concepts and embodiments which fall within the scope of the invention, some or none of the openings may be formed prior to or post-printing. Further, some or none of the openings may be formed prior to or post-application of the liquid monomer and curing operations. Openings within interior regions of the article may be mounting holes, cut-outs for electronic displays, design features, clearance holes for assembly fasteners, keyhole slots, and other discontinuities of the substrate.

In accordance with other aspects of the invention, the bare substrate forming the border region around the periphery of the article will preferably be continuous, without breaks. The substrate should encircle the entirety of the plurality of ink sites on the substrate including and broad areas constituting a colored background. Correspondingly, the bare substrate forming the border region around any interior openings on the substrate should preferably be continuous, and again without breaks and encircling any opening on the substrate.

With respect to graphic designs, the designs preferably will preclude the use of ink or other materials within the areas defined as edge and/or openings bare borders. Such borders were previously discussed herein, and referenced with respect to FIGS. 6-13.

Still further, within specifications and the overall appearance of the desired indicia, a graphic design should preferably maximize use of bare substrate to create the desired image. Further, indicia should be designed with bare areas in all regions that will have secondary shaping operations so as to form the final size and shape of the article. Further, it is preferable to maximize use of localized bare substrate regions within the boundaries of the desired image.

In accordance with other aspects of the invention, conventional methods and printing equipment can be utilized to form a design layer of ink on the substrate, so as to create the desired image. In addition, conventional methods and equipment can be utilized to cut the substrate into desired shapes and sizes, either prior to or subsequent to printing. Similarly, conventional methods and equipment can be utilized to cut the substrate into desired shapes and sizes, either prior to or subsequent to polymer curing. In this regard, and in accordance with the invention, the method should include covering 100 percent of the surface of the substrate (e.g., edge-to-edge) with a liquid polymerizable monomer.

The liquid polymerizable monomer should cover the ink forming the design layer, as well as the bare substrate forming the edge border. In addition, the monomer should cover the bare substrate forming opening edge borders and any other bare substrate regions within the boundaries of the desired image. The liquid polymerizable monomer should preferably be applied by rollers, spray, brush, or other conventional methods to achieve a relatively thin uniform layer void of pin-holes, bubbles, voids, puddles, and contaminants. Still further, the liquid polymerizable monomer can be acrylate based, or other material that when polymerized, will form a clear, colorless, and transparent layer. The protective coating may not be adhered to the indicia and substrate by an adhesive layer.

When working with the liquid polymerizable monomer, it is preferable for the monomer to be cured immediately after being applied, by moving the article past high-intensity UV radiation lamps. With this activity, the liquid monomer is cured through steps which can be characterized as including:

1. Photo polymerization initiators absorbing UV light energy;
2. The activated photo polymerization initiators reacting with other components in the liquid, such as oligomers and monomers;
3. The reactions initiating chain reactions causing three-dimensional cross-linking; and
4. As the cross-linking proceeds and molecular weight increases, liquid is cured into a solid layer.

In accordance with other aspects of the invention, the monomer can be polymerized and will aggressively bond to the edge bare borders and openings bare borders, as well as localized bare regions on the substrate. The monomer will fully encapsulate the ink forming the design layer between the protective coating and substrate.

It is also preferable for the edge and openings bare borders to be sufficiently wide so as to provide adequate surface area to bond the polymer to the substrate, and prevent incipient edge delaminating in normal use which includes cleaning of the article using high pressure sprays, high temperature sprays, chemicals, and abrasives.

In accordance with the foregoing, and the methods associated with the invention, complete edge and openings bare borders of the article will afford maximum protection to the design layer and bare surfaces of the article. Further, an article with a polymerized layer covering 100 percent of the surface and bonded to a bare border along the periphery of the article can be characterized as being completely encapsulated between the protective coating and substrate. Correspondingly, an article with a polymerized layer covering 100 percent of the surface and bonding to a bare border surrounding all openings in the substrate of the article is also said to be encapsulated between the protective coating and substrate. Still further, an article with a polymerized layer covering 100 percent of the surface and bonded to a bare border along the periphery, with a series of bare substrate regions in addition to the border of the article can be characterized as being encapsulated between the protective coating and substrate, with localized encapsulation between the protective coating and substrate.

Further in accordance with the invention, the polymerized layer will not diminish or otherwise impair the ability of a viewer to see the indicia in its entirety, without distortion, changes in color, or reduced clarity, relative to the uncoated image. The methods in accordance with the invention includes encapsulation of the image between the protective coating and substrate in a manner so no exposed surface areas or tags along the edges exist. A non-porous clear protective layer should be formed over the surface thereby encapsulating the indicia on the article between the protective coating and substrate.

Still further, it is preferable for a moisture-resistant clear protective layer to be created, over the indicia and encapsulating between the protective coating and substrate the indicia on the article. Still further, a pin-hole free clear protective layer should be formed over and encapsulating the indicia between the protective coating and substrate. In addition, the methods in accordance with the invention create a scratch-resistant clear protective layer over and encapsulating the indicia between the protective coating and substrate. Also, the clear protective layer formed to encapsulate the indicia between the protective coating and substrate should be resistant to ultraviolet light induced color fading of the indicia. In addition, the clear protective layer should be chemically resistant, as well as being solvent-resistant.

Still further, the clear protective layer which is encapsulating the article's indicia between the protective coating and substrate should be resistant to high pressure water streams. In addition, the layer should be resistant to damage resulting from high temperatures (e.g., greater than 212° F.). From a practical viewpoint, the clear protective layer also affords the capability of clean-up of graffiti or similar types of vandalism. In the same regard, it is preferable for the clear protective layer to be resistant to abrasion.

Also associated with methods and attributes in accordance with the invention are advantages of optimizing adhesion properties. Specifically, the surface energy of the substrate and the surface tension of the monomer UV-curable coating can provide enhanced wetting and adhesion properties to the substrate, superior to the bond formed by inks or adhesive-based laminates. This enhanced wetting and adhesion bond formed by the protective coating and substrate along the periphery of the bare border and bare borders surrounding all openings create the maximum seal and protection for the indicia.

For purposes of complete understanding and disclosure of embodiments to the invention, it is worthwhile to include, within the Application, results of physically realizable testing associated with the properties of the invention. In this regard, it can be stated by the inventors that signs and labels with edge and opening surface encapsulation have been tested with a broad range of cleaning chemicals and mechanical methods. Severe cleaning methods may employ one or more of the following:

1. High pressure (above 3,000 psi) water jet cleaning;
2. High temperature steam cleaning;
3. Chemical washing (e.g., with mineral spirits, paint thinners, turpentine, 90 percent isopropyl alcohol, ammonia, bleach, and the like; and 4. Abrasives, such as scrub pads and scouring powders.

The polymer layer performed as anticipated on general surface areas consistent with published physical and chemical properties for acrylate polymers. Graffiti, oils, paints, markers, and general dirt were removed from the article primarily by the use of 90 isopropyl alcohol. The 90 percent isopropyl alcohol and other solvents that were tested did not degrade the polymer layer or indicia. Conversely, signs without a bare border on the periphery of the article and bare borders surrounding openings exhibited degradation to the ink layer along exposed edges. Similar results were observed when high pressure water cleaning was employed. The edge and opening surface encapsulated signs showed no degradation of the polymeric layer or indicia. Conversely, the signs without a bare border had evidence of incipient to major delaminating along the sides of the article.

With inventions of a type with which this Application is associated, it is also worthwhile to assess the protections accorded by specific processes through the use of testing protocols which provide for comparison studies between newly-developed processes and those which are commercially known and within the prior art. For the parts and processes developed in accordance with this invention, test methods have been developed to assess the protection provided by a encapsulating indicia between the protective coating and substrate on an article. Specifically, the testing protocol will distinguish that indicia designs incorporating bare substrate regions along outside edges of the article, and interior edges along any opening (e.g. mounting holes) to have superior bonding characteristics that are resistant to bond rupture versus indicia designs that require inks to be applied in similar regions extending to exterior and interior edges on the article. Since there are not absolute quantitative methods to measure delaminating resistance, the testing protocol developed for the invention uses observations of edges within and without bare borders at highly localized regions. A comparison is then done of the extent of delamination between two adjacent sites after applying stress mechanically through the use of high pressure water spray to the article.

Figure 15:
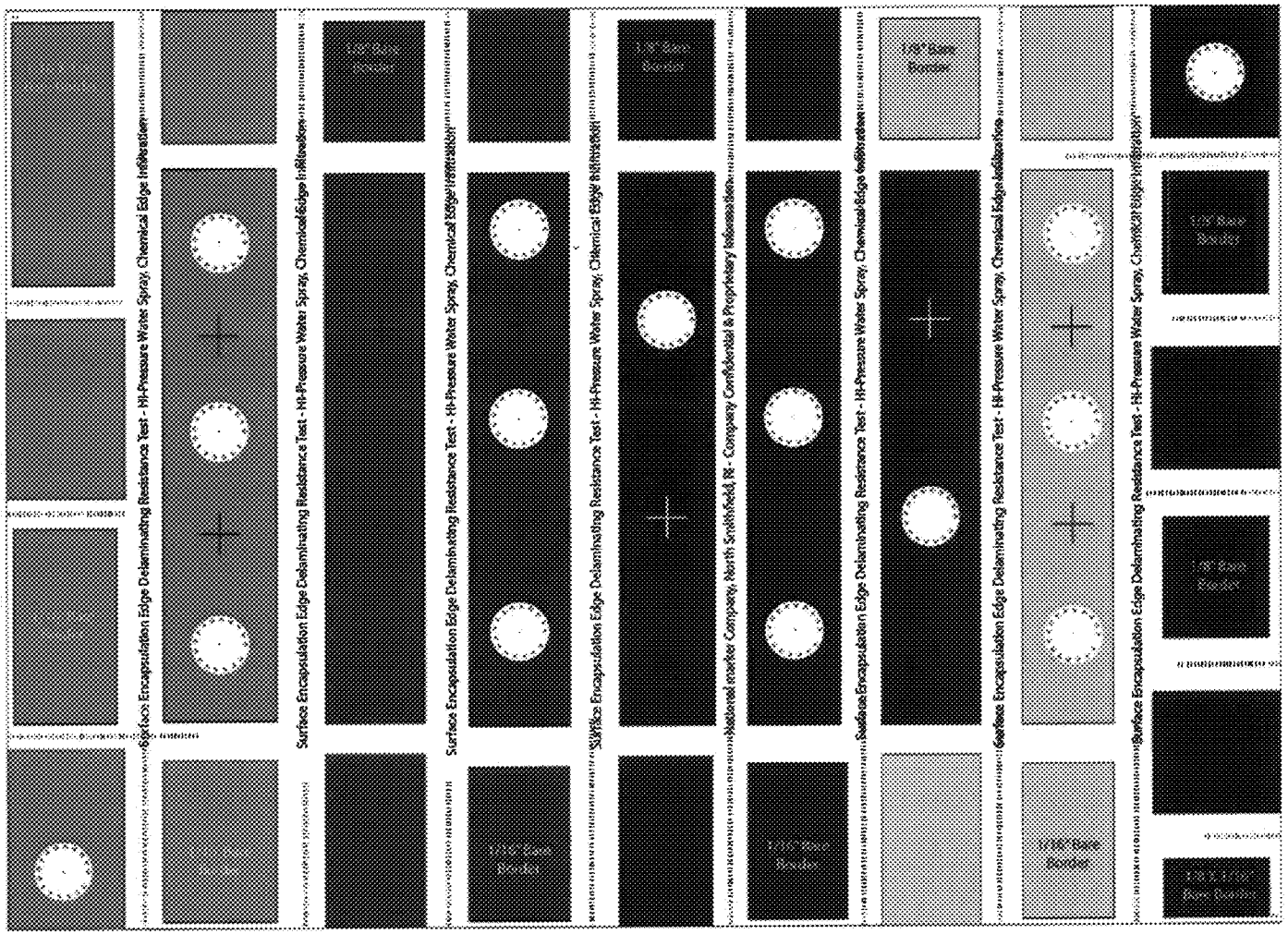
FIG. 15 is a view of an example embodiment of a delaminating resistance test color grid used with test methods to assess the protection provided by surface encapsulating indicia on an article.
Figure 16:
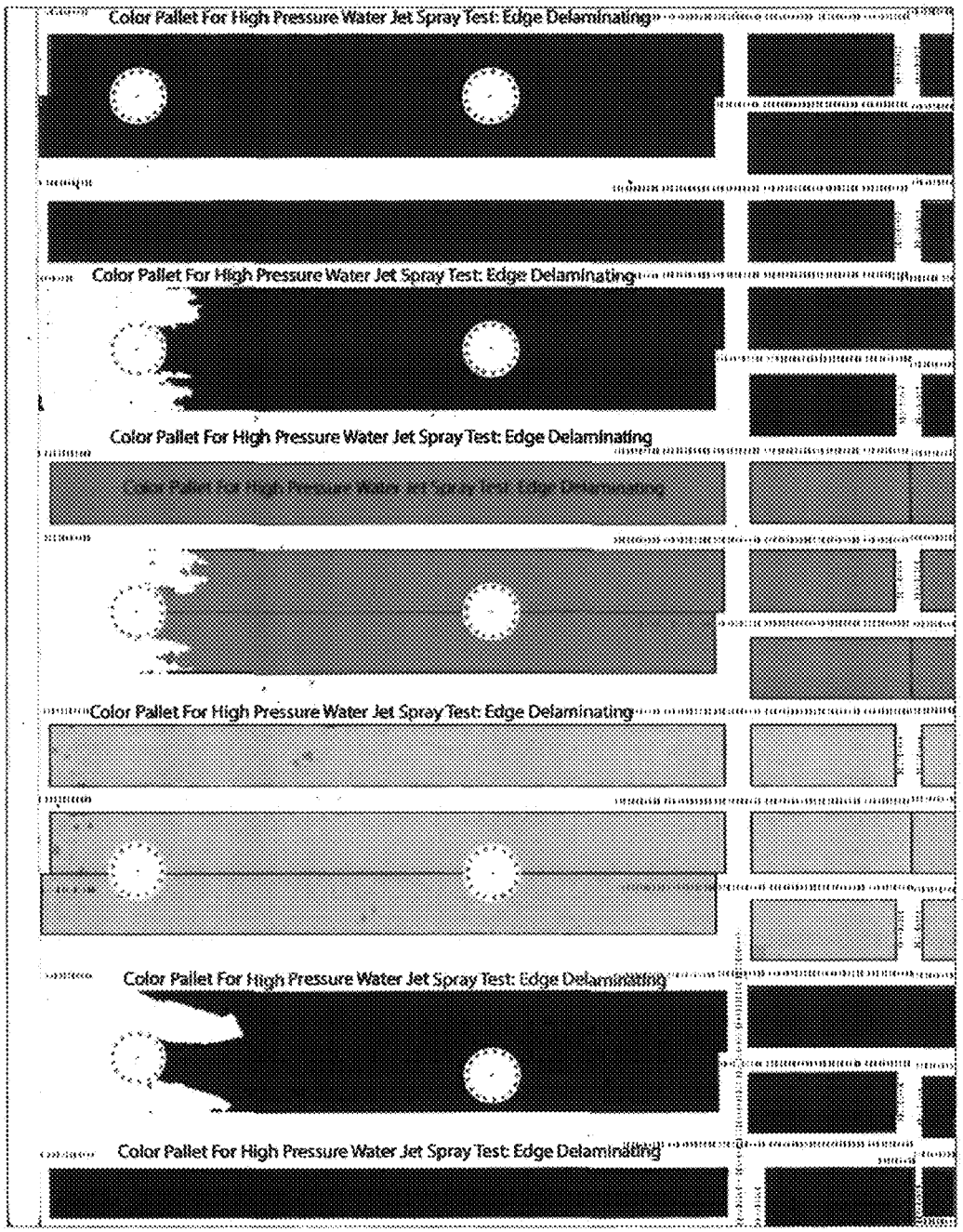
FIG. 16 is a view of a color pallet showing incipient delaminating at openings and edges having indicia and resultant progressive delaminating as a result of employing a high pressure water jet spray onto the article.
Figure 18:
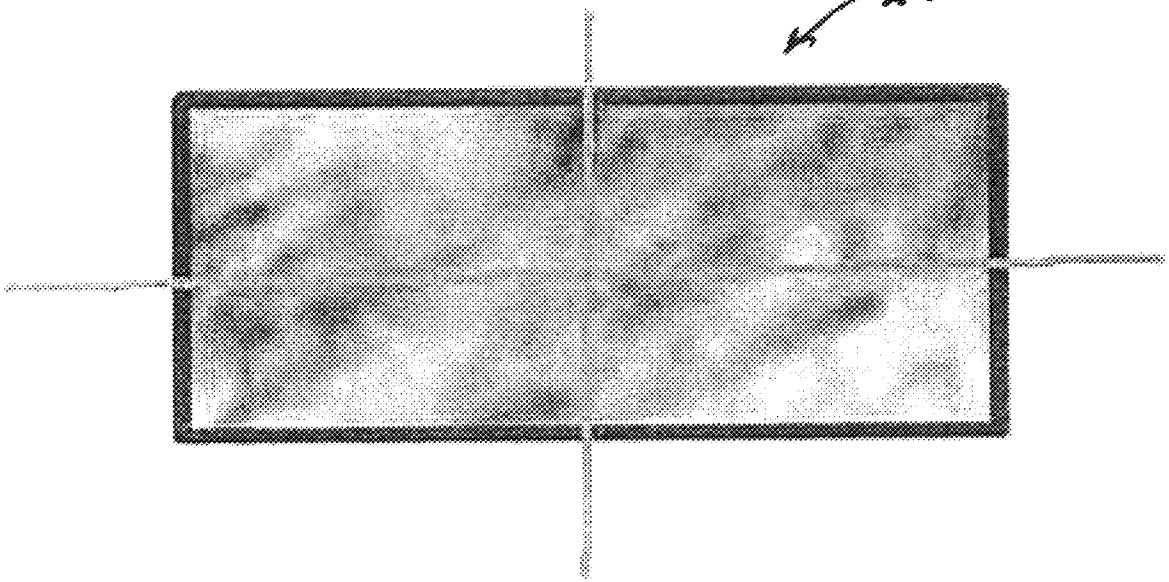
FIG. 18 is a symbol for a rectangular cut-out opening in the substrate. The image attempts to show a non-round opening with a bare interior border along the aperture's opening.
Figure 17:
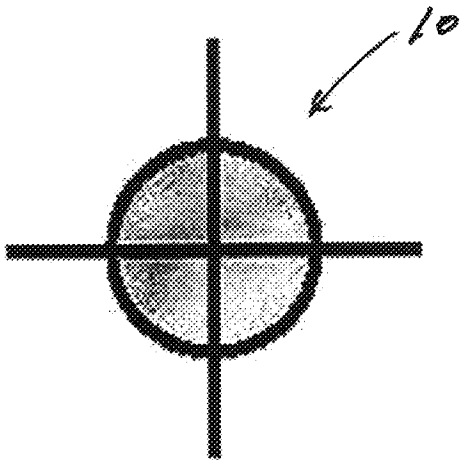
FIG. 17 is an image of symbols that will be utilized in other drawings to denote a round hole or similar opening in the substrate.

In accordance with this testing, a single indicia design has been utilized which incorporates both bare substrate regions along exterior and interior edges of the article, and printed substrate regions along exterior and interior edges of the article. Images of the test materials are illustrated in FIGS. 15 and 16. Therein, the indicia is shown as consisting of "colored bars" which can be approximately one-inch wide, and ranging from approximately 0.625 inches to six inches in length. Within the color bars are locations for purposes of drilling holes, either pre or post-encapsulation. The hole locations are designed and located so as to provide a bare inside border (providing 16 sites) and no bare border (12 sites). The bare imprinted regions are designed to be in close proximity of each other, in order to minimize the effect of variables across a surface of the article. Such variables can be in the form of substrate surface texture, ink colors, ink thickness, protective coating thickness, curing of ink and protective coating, and the like. Placing bare and printed regions in close proximity will allow uniformity of results when comparing indicia protection levels between adjacent printed regions exposed to different levels of mechanical stress.

The indicia test pattern used with these particular tests and testing protocols incorporated strips of very small multi-colored tick marks. Such marks could be 0.044 inches long by 0.008 inches wide, and spaced approximately 1 mm apart. The small tick marks have very poor ability to stay adhered to the substrate, primarily due to the very small area that each mark contacts with the substrate (i.e. less than 0.001 square inches). If the tick marks are left as printed, without any protective layer, the marks are readily removed from a substrate by chemical or mechanical means. The colored tick marks are located perpendicular to the outer edges of the article in the bare substrate regions and are used to more easily identify where the polymer coating is still present in the bare substrate regions post-delaminating resistance testing. Because the polymer is clear, its presence or removal can be difficult to determine without the colored tick marks. The tick marks are below the polymer coating and only will be present if the coating remains intact. The amount of ink to produce the tick marks is insignificant, and does not in itself augment adhesion nor encourage delaminating of the larger regions of ink or polymer on the bare surfaces. The neutral nature of the tick marks is evident throughout the test results. A key indicator of successful encapsulation between the protective coating and substrate that inhibits delaminating is a presence of the tick marks post-testing (high pressure water jet) along all outside edges of the article.

The locations for 28 of the openings or holes 10 are marked by a cross († or +) indicating the center of the hole 10. There are 16 locations that incorporate a bare border with marks around the outer edge of the bare border. The 16 locations with the bare border are sized so as to accept a 0.375 inch diameter opening. The marks are Myriad Pro asterisks that measure approximately 0.05 inches in diameter. Similar to the multi-colored tick marks previously described herein, the miniature asterisks function as physical indicators of the presence or absence of the polymer coating on the bare substrate near the opening. Like the multi-colored tick marks, each small asterisk has poor adhesion properties to the substrate due to the very small contact area projected onto the substrate. The small asterisks are below the polymer coating and will only be present if the polymer coating is intact. There are 12 additional locations without a bare border region to drill or punch openings. Without a bare border, the 12 locations can accept holes up to 0.75 inches in diameter, without the resultant opening exceeding the width of the colored bars. For proper comparison of delaminating in the region of openings with borders, versus openings without borders, the size of the opening will be the same. A key indicator of successful surface encapsulation that inhibits delaminating is the presence of the asterisks post-testing along all outside borders surrounding an opening.

The indicia displayed in FIGS. 15 and 16, during experimentation, were printed on the substrates listed below:

1. 0.040 inch thick aluminum, with a white baked enamel surface coating.
2. 0.050 inch thick polystyrene pigmented white.
3. 0.0045 inch thick pressure sensitive vinyl sheet pigmented white.

The indicia will be printed on a substrate in such a manner so as to alternately create 0.125 inch and 1/16 inch bare borders and printed regions extending to the edges of the substrate as displayed in FIGS. 15 and 16. The base size of the test image is 10 inches high and 14 inches wide. The test image is designed to have square corners and includes regions to drill or punch 16 holes with bare borders, and 12 holes in ink layers without bare borders. Indicia displayed in FIGS. 15 and 16 were printed using the printed methods listed below:

1. Water-based ink jet.
2. UV inkjet.
3. Screen print UV ink.

Two samples of each combination of ink type and substrate are obtained, for purposes of completing one test set. All substrates are printed, coated with a liquid monomer and UV cured so as to form the polymerized coating a minimum of 24 hours before a test is initiated. It is recognized that full polymerization of the protective layer does not happen immediately after applying and curing the polymer, but requires at least 24 hours to reach full hardness and adhesion to the substrate.

Within the realm of testing protocols which may be applied to articles and methods in accordance with the invention, mechanical stresses applied to the edges of the article in the testing protocol are extremely difficult to be precisely controlled or measured. Different regions on the article will experience differing levels of mechanical stress. The close proximity of the colored bars with bare borders and colored bars printed on the edge of the article result in both colored bar sets experiencing the same mechanical stress levels in a highly localized section of the article. Different edge connections may experience higher or lower mechanical stress, and may exhibit differing levels of delaminating. Localized areas will exhibit different delaminating results, dependent upon the level of mechanical stress that is applied.

The following paragraphs will now describe the operation and results of a mechanical delaminating test utilized to prove the significant advantages of articles and methods in accordance with the invention. The tests encompassed the following:

1. The delaminating test utilized a high pressure (≥1000 PSI) water spray in a fan or jet pattern directed at one edge of the article at a time. The spray moved from side to side and up and down, so as to insure the high pressure stream is hitting all areas along the edge. The spray was maintained until delaminating and lift-off of ink was evident. The test was repeated on all four sides of the test article.

2. The test used a high pressure water spray in a fan pattern directed at one edge of all openings, one at a time. The spray moved from side to side and up and down, so as to insure that the high pressure stream was hitting the chosen edge of the opening. The spray was maintained until delaminating and lift-off of ink was evident at most openings without borders.

3. The test article was then allowed to air dry. No paper or cloth towels were used to dry the article itself.

4. After all water and moisture evaporated, the test article was then inspected and photographed, and/or scanned, so as to determine the efficacy of the polymer coating and indicia design. The efficacy of the protective polymer coating is validated by observing significant delaminating of colored bars that extend to the outer edges of the article, and openings (holes) with no bare borders and minimal to zero delaminating of colored bars and areas around openings incorporating bare borders. These comparisons are valid for adjacent and same colored bars and openings (holes) in the same colored bars.

5. The tester recorded the date, tester's name, substrate material, purchaser or manufacturer and model, ink type and polymer function to be completely visible in the aforementioned photograph or scan.

6. The tester should document his/her observations by indicating the amount of delaminating as "N" (meaning none); 100%; or "P" (meaning Partial). The mechanical delaminating test does not attempt to distinguish levels of adhesion nor create consistent, uniform and repeatable stresses on the edges of the multiple articles. Instead, the test determines the resistance to delaminating for fully encapsulated indicia versus edge exposed indicia. Partial or 100 percent delaminating of fully encapsulated (bare borders around all printed areas) indicia is a failure of the polymer to create a durable bond with the substrate and failure to protect the indicia by surface encapsulating all ink regions. The broad measures of degree of delaminating as N, 100 PERCENT or P are consistent with the test methodology and result that did not produce incremental quantifiable ranges of resistance to delaminating.

It will be apparent to those skilled in the pertinent arts that other embodiments of coated articles and methods for coating in accordance with the invention can be designed. That is, the principles of coated articles and methods of applying protective coatings in accordance with the invention are not limited to the specific embodiments described herein. Accordingly, it would be apparent to those skilled in the art that modifications and other variations of the above-described lesser embodiments of the invention may be effected without departing from the spirit and scope of the novel concepts of the invention.

What is claimed is:

1. An article of manufacture in the form of a sign or label, said sign or label comprising a substrate forming a flat planar surface having any one of a plurality of shapes, thicknesses and sizes, said article of manufacture comprising:

a design layer formed with inks applied to said substrate in a predetermined pattern, so as to convey visual information to a viewer;

said substrate having one or more edges formed around a periphery of said sign or label, said one or more edges forming a bare edge border;

said inks applied to said substrate are absent from said bare edge border;

said article of manufacture further comprising a protective layer formed over said inks so as to provide a protective cover to said inks and to said substrate under said inks;

said protective layer fully covers and encapsulates not only said design layer but also said bare edge borders formed on said substrate where a developer has refrained from applying said inks;

said sign or label comprises at least one mounting hole for mounting said article of manufacture to a post, wall, or other supporting structure;

an openings bare border is positioned as a periphery around said mounting hole, and no portion of said inks is applied to said periphery around said mounting hole;

said protective layer also fully encapsulates said openings bare border;

said openings bare border formed as a periphery around said mounting hole is spaced apart and distinct from said bare edge border formed by said one or more edges of said substrate, and separated from said bare edge border by inks of said design layer; and direct contact of said protective coating to said substrate on said bare edge borders and said openings bare border formed as a periphery around said mounting hole is achieved without the use of any layers of adhesives along said bare edge border or said openings bare border formed as a periphery around said mounting hole, and said resultant structure of said article of manufacture provides relatively increased resistance to delamination from subsequently occurring physical phenomena applied to said article of manufacture.

* * * * *